US012569900B2

(12) United States Patent
Gentile et al.

(10) Patent No.: US 12,569,900 B2
(45) Date of Patent: Mar. 10, 2026

(54) AUTOMATED ROD COIL CUTTING STATION

(71) Applicant: PRIMETALS TECHNOLOGIES USA LLC, Alpharetta, GA (US)

(72) Inventors: Margaret Gentile, Shrewsbury, MA (US); Sudhakar Teegavarapu, Hopkinton, MA (US); Matthew Palfreman, Worcester, MA (US); David Gow, Sterling, MA (US)

(73) Assignee: Primetals Technologies USA LLC, Alpharetta, GA (US)

( * ) Notice: Subject to any disclaimer, the term of this patent is extended or adjusted under 35 U.S.C. 154(b) by 59 days.

(21) Appl. No.: 18/271,535

(22) PCT Filed: Jan. 6, 2022

(86) PCT No.: PCT/US2022/011388

§ 371 (c)(1),
(2) Date: Jul. 10, 2023

(87) PCT Pub. No.: WO2022/150440

PCT Pub. Date: Jul. 14, 2022

(65) Prior Publication Data

US 2024/0351082 A1 Oct. 24, 2024

(51) Int. Cl.

| | |
|---|---|
| ***B21C 47/14*** | (2006.01) |
| ***B21C 47/04*** | (2006.01) |
| ***B21C 47/26*** | (2006.01) |

(52) U.S. Cl.

CPC ..... *B21C 47/143* (2013.01); *B21C 47/04* (2013.01); *B21C 47/146* (2013.01); *B21C 47/26* (2013.01)

(58) Field of Classification Search

CPC ..... B21C 47/143; B21C 47/04; B21C 47/146; B21C 47/26

See application file for complete search history.

(56) References Cited

U.S. PATENT DOCUMENTS

| | | | |
|---|---|---|---|
| 2,886,258 | A | 5/1959 | Haugwitz |
| 3,776,076 | A | 12/1973 | Hauck |
| 4,011,780 | A | 3/1977 | Siegfried |
| 5,243,746 | A | 9/1993 | Shinichi |
| 5,273,231 | A | 12/1993 | Starvaski |
| 6,073,873 | A | 6/2000 | Shore et al. |
| 6,237,868 | B1 | 5/2001 | Shore et al. |
| 6,726,138 | B2 | 4/2004 | Grimmel et al. |
| 7,856,911 | B2 | 12/2010 | Hattersley, Jr. et al. |

(Continued)

FOREIGN PATENT DOCUMENTS

| | | | |
|---|---|---|---|
| CN | 102066017 | A | 5/2011 |
| CN | 104271278 | B | 12/2016 |

(Continued)

OTHER PUBLICATIONS

First office action issued by the State Intellectual Property Office of China dated Aug. 27, 2015 in related Chinese Patent App. No. 201380023324.0.

(Continued)

*Primary Examiner* — Omar Flores Sanchez

(74) *Attorney, Agent, or Firm* — Gesmer Updegrove LLP

(57) ABSTRACT

Disclosed within are various embodiments that provide for an automated rod coil cutting station for both ferrous and non-ferrous wire rod mills.

22 Claims, 21 Drawing Sheets

(56) References Cited

U.S. PATENT DOCUMENTS

| | | | | |
|---|---|---|---|---|
| 10,166,586 | B2 | 1/2019 | Castle | |
| 2005/0247261 | A1 | 11/2005 | Hattersley, Jr. et al. | |
| 2006/0266794 | A1* | 11/2006 | Melfi | B21C 47/146 228/56.3 |
| 2019/0291168 | A1* | 9/2019 | Teegavarapu | B25J 11/0055 |
| 2019/0291169 | A1 | 9/2019 | Teegavapu et al. | |
| 2022/0200422 | A1* | 6/2022 | Lee | H02K 15/095 |
| 2022/0219215 | A1* | 7/2022 | Gentile | B21C 47/146 |
| 2022/0288662 | A1* | 9/2022 | Quintal | B21C 51/00 |
| 2022/0410236 | A1* | 12/2022 | Pagliari | B65H 54/76 |
| 2023/0022455 | A1* | 1/2023 | Priem | B65H 54/72 |

FOREIGN PATENT DOCUMENTS

| | | | | | |
|---|---|---|---|---|---|
| CN | 212216596 | U | | 12/2020 | |
| DE | 2143449 | A1 | | 3/1973 | |
| DE | 2150419 | A1 | | 4/1973 | |
| DE | 2453834 | A1 | | 6/1975 | |
| DE | 2420866 | A1 | | 11/1975 | |
| DE | 2515643 | A1 | | 10/1976 | |
| DE | 19704421 | A1 | | 8/1998 | |
| EP | 0583099 | A1 | | 2/1994 | |
| EP | 0723825 | A1 | | 7/1996 | |
| EP | 0860217 | A2 | | 8/1998 | |
| GB | 1405613 | A | | 9/1975 | |
| GB | 1479278 | A | | 7/1977 | |
| GB | 1504386 | A | * | 3/1978 | B21C 47/24 |
| JP | S5575827 | A | | 6/1980 | |
| JP | S56119621 | A | | 9/1981 | |
| JP | S56175137 | U | | 12/1981 | |
| JP | S5994523 | A | | 5/1984 | |
| JP | S60122055 | A | | 6/1985 | |
| JP | S6135285 | U | | 3/1986 | |
| JP | H02112824 | A | | 4/1990 | |
| JP | H07155839 | A | | 6/1995 | |
| JP | 2001121342 | A | | 5/2001 | |
| RU | 1338186 | C | | 10/1996 | |
| SU | 384224 | | | 10/1973 | |
| WO | 9405445 | A1 | | 3/1994 | |
| WO | 2013164431 | A1 | | 11/2013 | |

OTHER PUBLICATIONS

Office action issued by Japanese Patent Office dated Mar. 17, 2017 in related Japanese App. No. 2015-509446.

Office action issued by Russian Patent Office dated Mar. 29, 2017 in related Russian App. No. 2014143996.

Office action issued by Chinese Patent Office dated Apr. 25, 2016 in related Chinese App. No. 201380023324.0.

Search Report issued by United Kingdom Patent Office dated Jun. 26, 2012 in related App. No. GB1207811.9.

PCT international Search Report dated Jul. 17, 2013 corresponding to PCT International App. No. PCT/US2013/059204 filed May 3, 2013.

International Search Report and Written Opinion dated May 2, 2022 corresponding to PCT International App. No. PCT/US2022/011388 filed Jan. 6, 2022.

Office Action issued by the Chinese Patent Office on Jun. 25, 2025 in related Chinese Patent Application No. 202280009690.X.

Hou, Yuehua et al., "5.5 mm Wire Rod Rolling and Reducing & Sizing Mill Application," Hebei Metallurgy, Issue 03.

* cited by examiner

AUTOMATED ROD COIL CUTTING STATION

PRIORITY INFORMATION

This application is a 371 of PCT Application No. PCT/US2022/11388 filed Jan. 6, 2022, which claims priority from U.S. application Ser. No. 17/145,484 filed Jan. 11, 2021, their entire contents and substance of which are herein incorporated by reference.

BACKGROUND OF THE INVENTION

Field of Invention

The present invention relates generally to the field of wire rod mills. More specifically, the present invention is related to an automated rod coil cutting station for ferrous and non-ferrous wire rod mills.

Discussion of Related Art

FIG. 1 depicts a typical production operation 100 in non-ferrous mills. In non-ferrous mills, such as ones used for copper and aluminum rod production, the production operation is usually carried out as a continuous process, starting with a casting mechanism 102 (e.g., a casting wheel or similar method) that continuously casts raw material into a shape. Next, one or more hot rolling units 104 are used to hot roll the product in a series of steps down to the desired rod diameter and cooled via cooling unit 106. Many mills then use a vertical coiler 108 to form the rod into a continuous helix that is deposited onto a pallet so that a coil is formed as the pallet is lowered below the vertical coiler 108.

FIG. 2A depicts the coil being formed in a tub, with the leading end of the rod temporarily attached to a support, ready for manual handling after coil formation is complete.

When the desired coil mass is obtained, a set of retractable supports or fingers, also known as iris fingers, close to catch subsequent rings for the formation of a new coil. Between the first coil and the second coil, a section of rod, referred to as the umbilical cord, connects the two coils. This section of the rod (i.e., the umbilical cord) is then manually cut (a sample often taken from the end trailing from the first coil), where the loose end of the rod is wrapped by hand into a tidy bundle and placed next to the coil. This manual operation can be dangerous and monotonous for the operators.

FIGS. 2B-E further depict the manual separation of the umbilical cord and wrapping of loose ends.

FIG. 3 depicts a typical production operation 300 in non-ferrous mills. Ferrous mills can operate either continuously, with direct casting (via casting mechanism 302) to rolling (via one or more hot rolling units 304), or semi-continuously, with billets. After rolling (via one or more hot rolling units 304), the rod is also formed into a helix (via a helix formation unit 306) and placed onto a cooling conveyor or cooling unit 308, after which the rings go into a reform station 310 for collection in the form of a coil. When the desired mass is collected on a first coil, a set of retractable supports or fingers, also known as reform tub iris 312, close to start collecting a second coil, which a coil plate lowers with the first coil. Similar to the case above, an umbilical cord of rod remains between the two coils.

On ferrous mills, the cord must be simple cut—this is done now with a reform tub shear, which is mechanically complex and expensive. FIG. 4 depicts an example of a ferrous mill reform station and FIG. 5 depicts an example of a ferrous mill reform station with a tub shear.

FIG. 6 depicts an example of a typical process for forming steel rod in a wire rod mill involves reheating cast steel billets in a furnace 602 and carrying out a continuous hot rolling process in roughing section 604, intermediate section 606 and finishing section 608 to form continuous wire rod. The wire rod is partially cooled in cooling section 610 and formed into loops 614 by a laying head 612 and laid on a cooling conveyor 616, such as a Stelmor-type conveyor, which carries the loops 614 to a reform chamber 618. At the reform chamber 618, the loops are dropped vertically onto a central guide in a reform tub and formed into an annular coil in the reform tub with the assistance of a rotating guide surface, for example of the type as described in EP0583099.

The reform chamber 618 of FIG. 6 in which such a divider can be used is illustrated in more detail in FIGS. 7A through 7C. As shown in FIG. 7A, a ring distributor 702 is provided at the entry to the reform tub 704. Reform tub 704 is generally cylindrical about an axis 706 and a nose cone 708 is provided above a stem 710, co-axial with the reform tub 704. A first iris 712 and a second iris 714 are mounted to the reform tub 704 as well as a shear 716. At the bottom of the reform tub 704 is a coil plate 718. A first control and drive system 720 is provided for the first iris 712 and the second iris 714, and a second control and drive system 722 is provided for the shear 716. Sensors 724 at the top of the reform tub are connected to the first control system 720. FIG. 7B shows the iris in its operating position, whereby the tabs 726, or fingers, of the iris protrude through the wall of the reform tub 704, the tips of the fingers close to, or in contact with the nose cone 708 to provide support to a coil being formed. In FIG. 7C, the iris is in its open position with the tabs retracted through the walls, so that the coil can fall down to the next support level.

FIGS. 7D-7H illustrate an example of operation of the reform device of FIGS. 7A-7C. As shown in FIG. 7D, loops 730 are brought by the conveyor 732 to the entry to the reform tub 704. At the entry to the reform tub 704, the rotating guide surface, or ring distributor 702, assists in producing a uniform distribution of coils in a controlled manner. The loops drop vertically passing through the ring distributor 702 onto the first iris 712 in the reform tub 704. A coil 728 forms inside the cylindrical reform tub 704, supported on the fingers 726 of the first iris 712 which are set at a position part-way down the reform tub 704. Typically, the tabs 726 are retractably mounted to project through the wall of the reform tub, their tips close to, in contact with, or passing through slots into the nose cone 708 in the center of and co-axial with the reform tub 704 when providing support, then retracted through the tub wall and out of the reform tub 704 when the first iris 712 is in its open position. The nose cone 708 assists in guiding the coils as they are formed. Sensors 724 determine when the coil 728 has reached a predetermined upper limit of coil height and send a signal to the controller 720 to cause the tabs 726 of the first iris 712 to be retracted, allowing the formed coil to drop by a fixed distance to the second iris 714, as illustrated in FIG. 7E. This second iris 714 will be in the position as previously depicted in FIG. 7B, with tabs of the second iris 714 extended into the reform tub 704.

The coiling process continues increasing the size of coil 730 until the top of the coil is determined to have reached the upper limit of coil height and a signal from the sensor 724 to the controller 720 causes the tabs of the second iris 714 to retract and drop this coil 730 a predetermined distance onto the coil plate 718. Between the coil plate 718 and the second iris 714, the shear 716 is mounted in an open position and does not interfere with the coil 730 dropping to the coil plate 718. Formation of the coil 732 continues as shown in FIG. 7F until the coils are again above the position of the first iris 712. The controller 720 then causes actuators to move the tabs 726 of the first iris 712 back into place, as illustrated in FIG. 7G and the coil plate 718 is dropped by a required amount in order for the coil 734 to be separated from coil 740 now held above the first shear 716. The separation distance opens out a helix, so that there is rod between the two coils 734, 740 set at a suitable angle for cutting and the shear 716 then operates to cut the rod. Where the tabs pass through into the nose cone 708, this allows the nose cone 708 and ring distributor 702 to be lifted by the first iris 712, so that the controller 720 can move the stem 710 down and away from the nose cone 708. Alternatively, the stem 710 may be lowered, whilst the first iris 712 provides support. The completed coil 734 on the coil plate 718 is moved down and extracted as shown in FIG. 7H. The coil plate 718 is then returned to its initial position.

As noted above, on non-ferrous mills, the coil separation process has historically been done manually, with no automation. Also, as noted above, on ferrous mills, reform tub shears are used, but they are expensive, require space in the reform station and are difficult to retrofit into existing reform stations.

Embodiments of the present invention are an improvement over prior art systems and methods.

SUMMARY OF THE INVENTION

In one embodiment, the present invention provides a system comprising: (a) a stem and a nose cone coaxially located above the stem; (b) a reform tub coaxially located with the nose and stem, the reform tub enclosing the nose and at least a portion of the stem; (c) at least one retractable iris mounted to the reform tub; (d) a retractable shear mounted to the reform tub and located underneath the retractable iris; (e) a coil plate located underneath the retractable shear; and (f) a robotic arm positioned underneath the retractable shear; the controller: (1) setting the retractable iris to engage the nose while holding a coil within the reform tub, and upon the coil attaining a pre-determined height, the controller retracting, for a pre-determined time period, the retractable iris to no longer engage the nose wherein, upon such retraction for the pre-determined time period, a portion of the coil falls to the coil plate; (2) after expiration of the pre-determined time period, setting the retractable iris to engage the nose where a remainder of the coil is held within the reform tub; (3) setting the retractable shear to not impede with the portion of the coil or the remainder of the coil, wherein the portion of the coil and the remainder of the coil are separated by an umbilical cord, (4) setting the retractable shear to sever the umbilical cord, and (5) sending one or more instructions to the robotic arm to convey a severed end of the umbilical cord to a feed mechanism or a carrier.

In another embodiment, the present invention provides a method as implemented in a reform station unit of a wire rod mill system, the reform station unit comprising: a stem and a nose cone coaxially located above the stem; a reform tub coaxially located with the nose and stem, the reform tub enclosing the nose and at least a portion of the stem; at least one retractable iris mounted to the reform tub; a retractable shear mounted to the reform tub and located underneath the retractable iris; a coil plate located underneath the retractable shear; and a robotic arm positioned underneath the retractable shear, the method comprising the steps of: (a) setting the retractable iris to engage the nose while holding a coil within the reform tub, and upon the coil attaining a pre-determined height, the controller retracting, for a pre-determined time period, the retractable iris to no longer engage the nose wherein, upon such retraction for the pre-determined time period, a portion of the coil falls to the coil plate; (b) after expiration of the pre-determined time period, setting the retractable iris to engage the nose where a remainder of the coil is held within the reform tub; (c) setting the retractable shear to not impede with the portion of the coil or the remainder of the coil, wherein the portion of the coil and the remainder of the coil are separated by an umbilical cord; (d) setting the retractable shear to sever the umbilical cord, and (e) sending one or more instructions to the robotic arm to convey a severed end of the umbilical cord to a feed mechanism or a carrier.

In yet another embodiment, the present invention provides a system comprising: (a) a stem and a nose cone coaxially located above the stem; (b) a reform tub coaxially located with the nose and stem, the reform tub enclosing the nose and at least a portion of the stem; (c) at least one retractable iris mounted to the reform tub; (d) a robotic arm with a shear mounted thereon and a set of pincers, the robotic arm and the pincers located beneath the retractable iris; and (e) a coil plate located underneath the robotic arm; the controller: (1) setting the retractable iris to engage the nose while holding a coil within the reform tub, and upon the coil attaining a pre-determined height, the controller retracting, for a pre-determined time period, the retractable iris to no longer engage the nose wherein, upon such retraction for the pre-determined time period, a portion of the coil falls to the coil plate; (2) after expiration of the pre-determined time period, setting the retractable iris to engage the nose while holding a remainder of the coil within the reform tub; (3) setting the robotic arm and the set of pincers to not impede with the portion of the coil or the remainder of the coil, wherein the portion of the coil and the remainder of the coil are separated by an umbilical cord; (4) sending instructions to the set of pincers to position the umbilical cord for shearing; (5) sending instructions to the robotic arm to sever the umbilical cord using the shear mounted thereon, and (6) sending instructions to the robotic arm to convey a severed end of the umbilical cord to a feed mechanism or a carrier.

In yet another embodiment, the present invention provides a method as implemented in a reform station unit of a wire rod mill system, the reform station unit comprising: a stem and a nose cone coaxially located above the stem, a reform tub coaxially located with the nose and stem, the reform tub enclosing the nose and at least a portion of the stem, at least one retractable iris mounted to the reform tub, a robotic arm with a shear mounted thereon and a set of pincers, the robotic arm and the pincers located beneath the retractable iris, and a coil plate located underneath the robotic arm, the method comprising the steps of: (a) setting the retractable iris to engage the nose while holding a coil within the reform tub, and upon the coil attaining a pre-determined height, the controller retracting, for a pre-determined time period, the retractable iris to no longer engage the nose wherein, upon such retraction for the pre-determined time period, a portion of the coil falls to the coil plate; (b) after expiration of the pre-determined time period, setting the retractable iris to engage the nose while holding a remainder of the coil within the reform tub; (c) setting the robotic arm and the set of pincers to not impede with the portion of the coil or the remainder of the coil, wherein the portion of the coil and the remainder of the coil are separated by an umbilical cord; (d) sending instructions to the set of pincers to position the umbilical cord for shearing; (e) sending instructions to the robotic arm to sever the umbilical cord using the shear mounted thereon; and (f) sending instructions to the robotic arm to convey a severed end of the umbilical cord to a feed mechanism or a carrier.

In another embodiment, the present invention provides a system comprising: (a) a stem and a nose cone coaxially located above the stem; (b) a reform tub coaxially located with the nose and stem, the reform tub enclosing the nose and at least a portion of the stem; (c) at least one retractable iris mounted to the reform tub; (d) a first robotic arm with a shear mounted thereon, the robotic arm located beneath the retractable iris; (e) a second robotic arm and a third robotic arm for positioning coils; and (f) a coil plate located underneath the first, second, and third robotic arms; the controller: (1) setting the retractable iris to engage the nose while holding a coil within the reform tub, and upon the coil attaining a pre-determined height, the controller retracting, for a pre-determined time period, the retractable iris to no longer engage the nose wherein, upon such retraction for the pre-determined time period, a portion of the coil falls to the coil plate; (2) after expiration of the pre-determined time period, setting the retractable iris to engage the nose while holding a remainder of the coil within the reform tub; (3) setting the first, second and third robotic arms to not impede with the portion of the coil or the remainder of the coil, wherein the portion of the coil and the remainder of the coil are separated by an umbilical cord; (4) sending instructions to the second and third robotic arms to position the umbilical cord for shearing; (5) sending instructions to the first robotic arm to sever the umbilical cord using the shear mounted thereon, and (6) sending instructions to the first robotic arm to convey a severed end of the umbilical cord to a feed mechanism or a carrier.

In yet another embodiment, the present invention provides a method as implemented in a reform station unit of a wire rod mill system, the reform station unit comprising: a stem and a nose cone coaxially located above the stem, a reform tub coaxially located with the nose and stem, the reform tub enclosing the nose and at least a portion of the stem, at least one retractable iris mounted to the reform tub, a first robotic arm with a shear mounted thereon, the robotic arm located beneath the retractable iris, a second robotic arm and a third robotic arm for positioning coils, and a coil plate located underneath the first, second, and third robotic arms, the method comprising the steps of: (a) setting the retractable iris to engage the nose while holding a coil within the reform tub, and upon the coil attaining a pre-determined height, the controller retracting, for a pre-determined time period, the retractable iris to no longer engage the nose wherein, upon such retraction for the pre-determined time period, a portion of the coil falls to the coil plate; (b) after expiration of the pre-determined time period, setting the retractable iris to engage the nose while holding a remainder of the coil within the reform tub; (c) setting the first, second and third robotic arms to not impede with the portion of the coil or the remainder of the coil, wherein the portion of the coil and the remainder of the coil are separated by an umbilical cord; (d) sending instructions to the second and third robotic arms to position the umbilical cord for shearing; (e) sending instructions to the first robotic arm to sever the umbilical cord using the shear mounted thereon, and (f) sending instructions to the first robotic arm to convey a severed end of the umbilical cord to a feed mechanism or a carrier.

BRIEF DESCRIPTION OF THE DRAWINGS

The present disclosure, in accordance with one or more various examples, is described in detail with reference to the following figures. The drawings are provided for purposes of illustration only and merely depict examples of the disclosure. These drawings are provided to facilitate the reader's understanding of the disclosure and should not be considered limiting of the breadth, scope, or applicability of the disclosure. It should be noted that for clarity and ease of illustration these drawings are not necessarily made to scale.

FIGS. 7A-7H illustrate an example of operation of the reform device of FIGS. 7A-7C.

DESCRIPTION OF THE PREFERRED EMBODIMENTS

Figure 1:
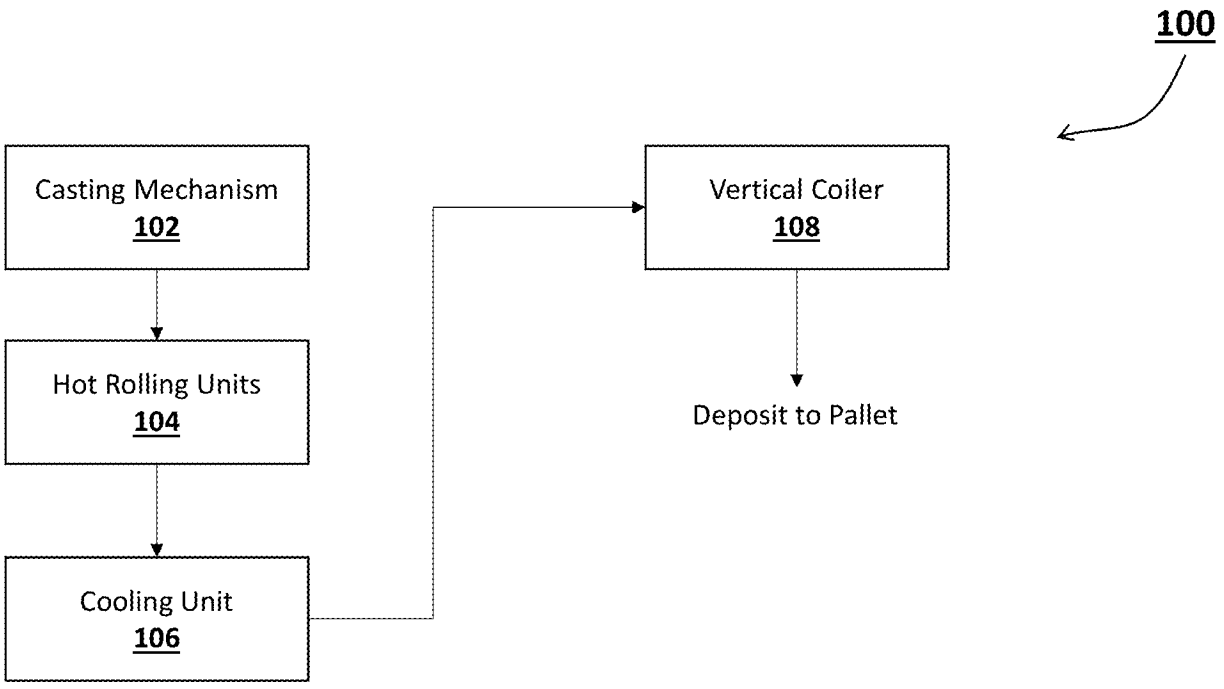
FIG. 1 (PRIOR ART)
FIG. 1 depicts a typical production operation in non-ferrous mills.
Figure 2A:
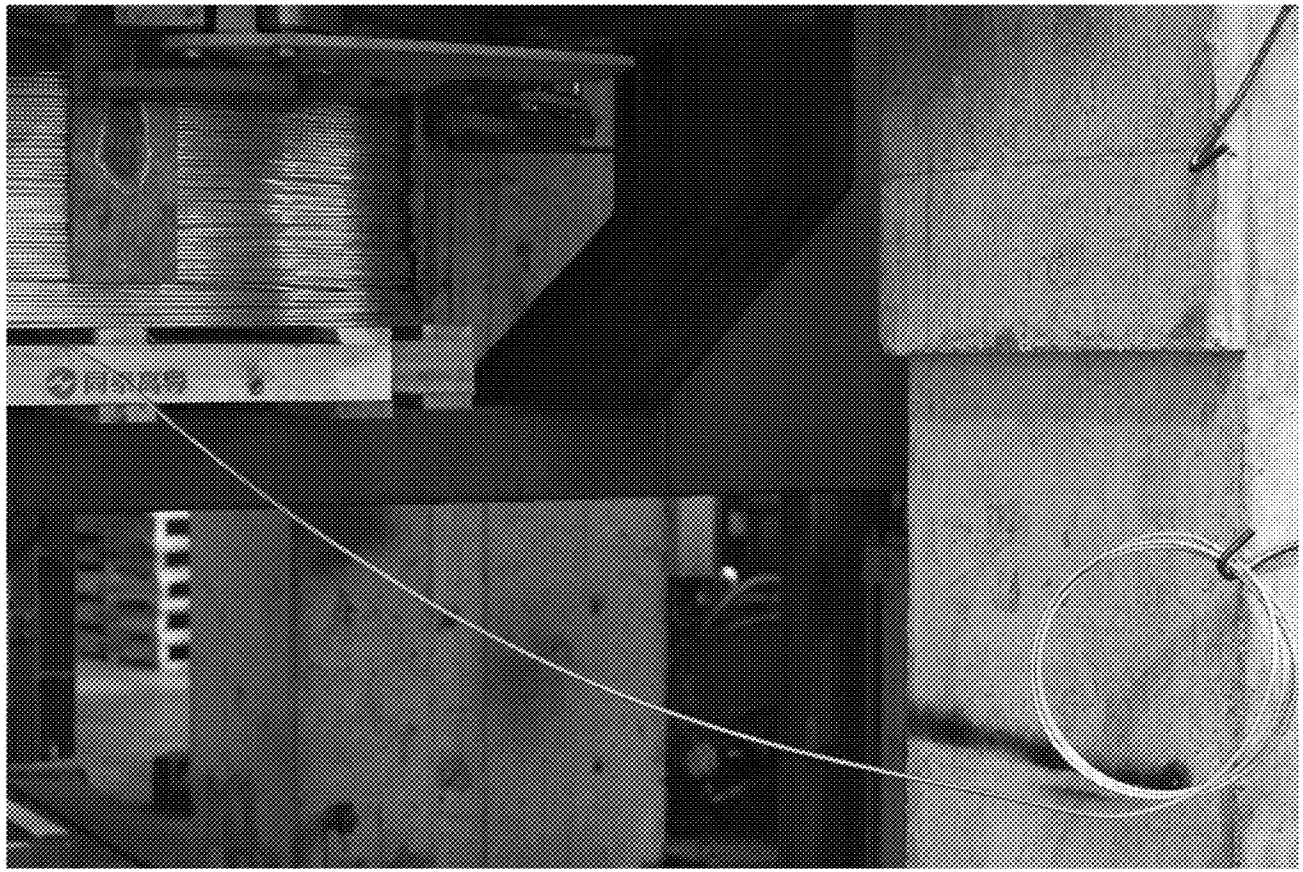
FIG. 2A (PRIOR ART)
FIG. 2A depicts the coil being formed in a tub, with the leading end of the rod temporarily attached to a support, ready of for manual handling after coil formation is complete.
Figure 2B:
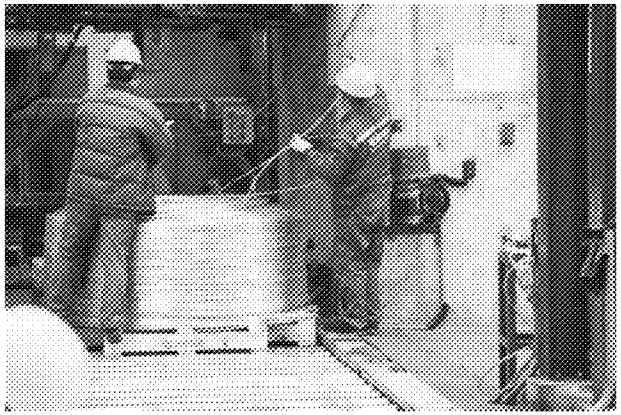
FIG. 2B (PRIOR ART)
FIGS. 2B-2E further depict the manual separation of the umbilical cord and wrapping of loose ends.
Figure 2C:
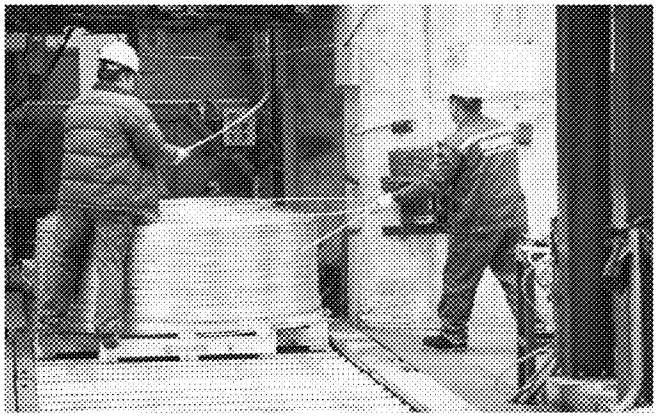
FIG. 2C (PRIOR ART)
Figure 2D:
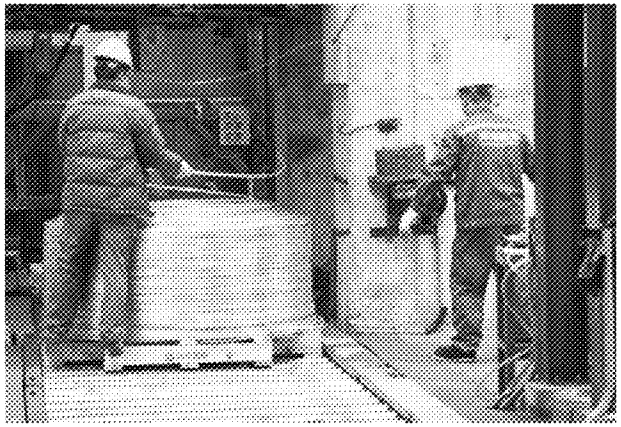
FIG. 2D (PRIOR ART)
Figure 2E:
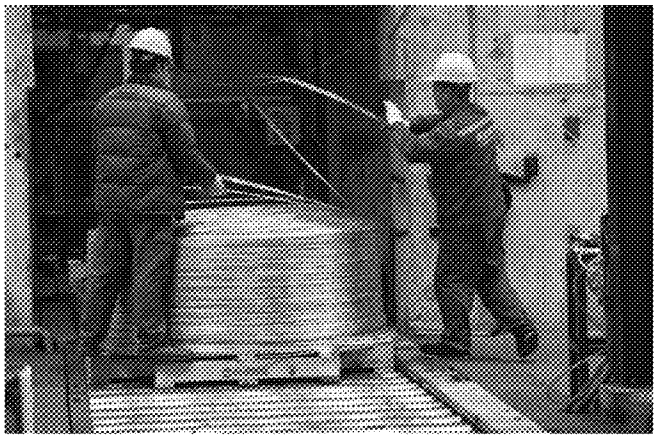
FIG. 2E (PRIOR ART)
Figure 3:
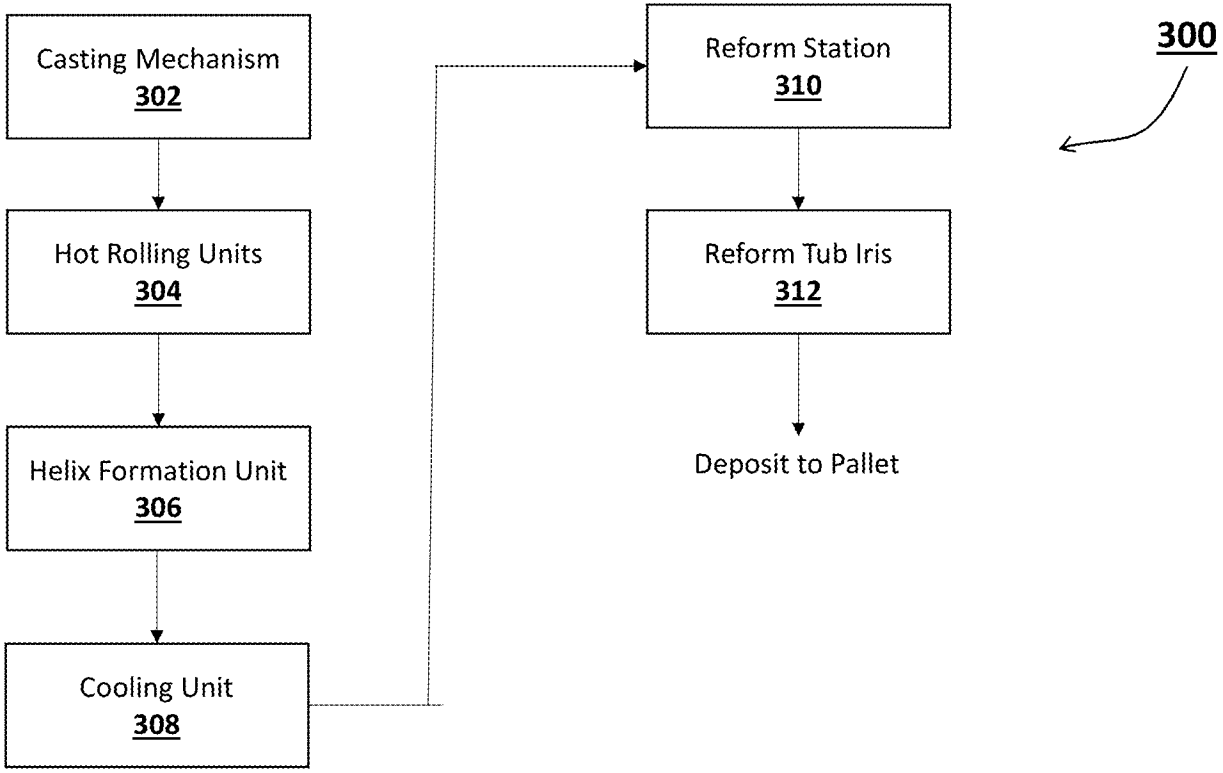
FIG. 3 (PRIOR ART)
FIG. 3 depicts a typical production operation in non-ferrous mills.
Figure 4:
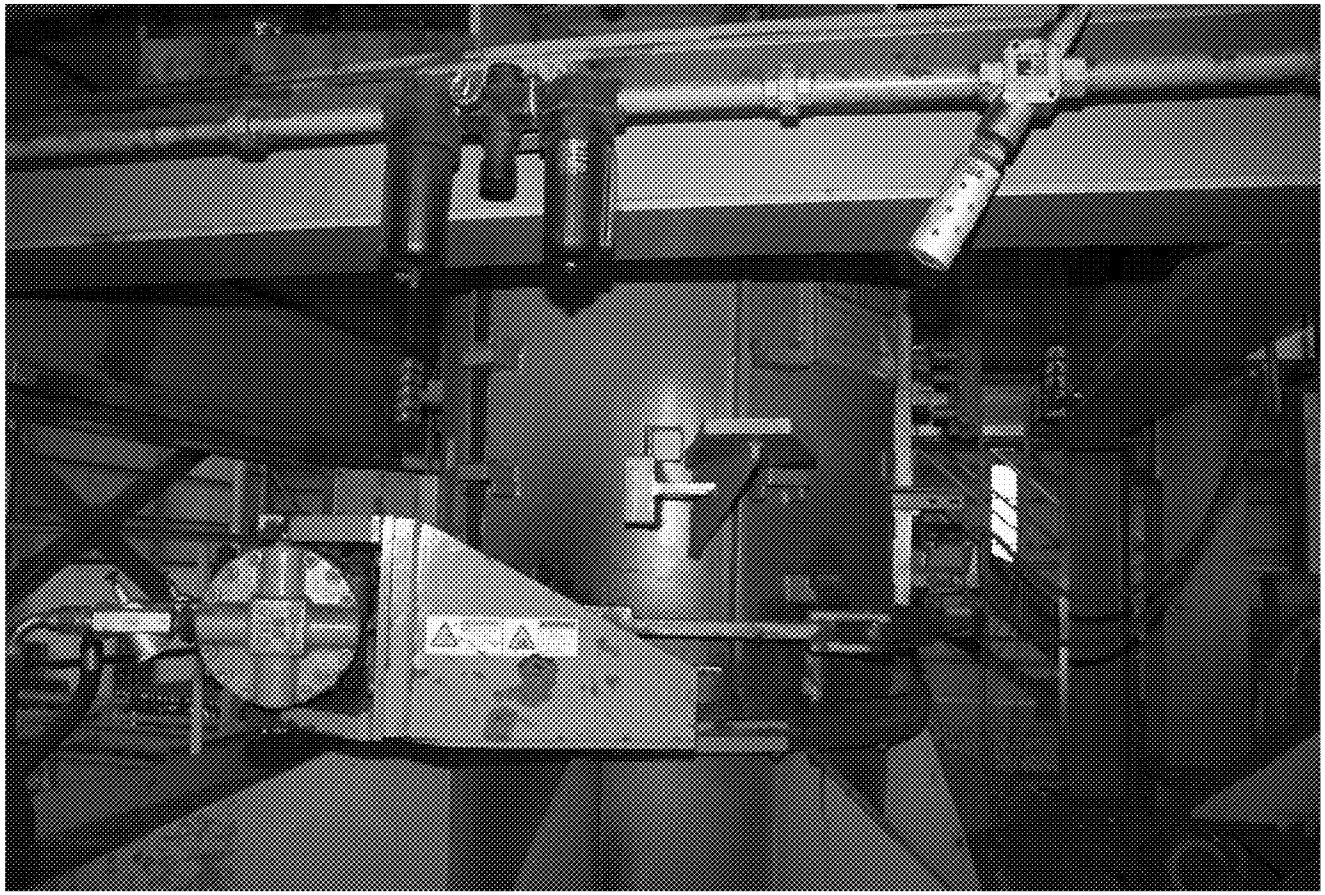
FIG. 4 (PRIOR ART)
FIG. 4 depicts an example of a ferrous mill reform station.
Figure 5:
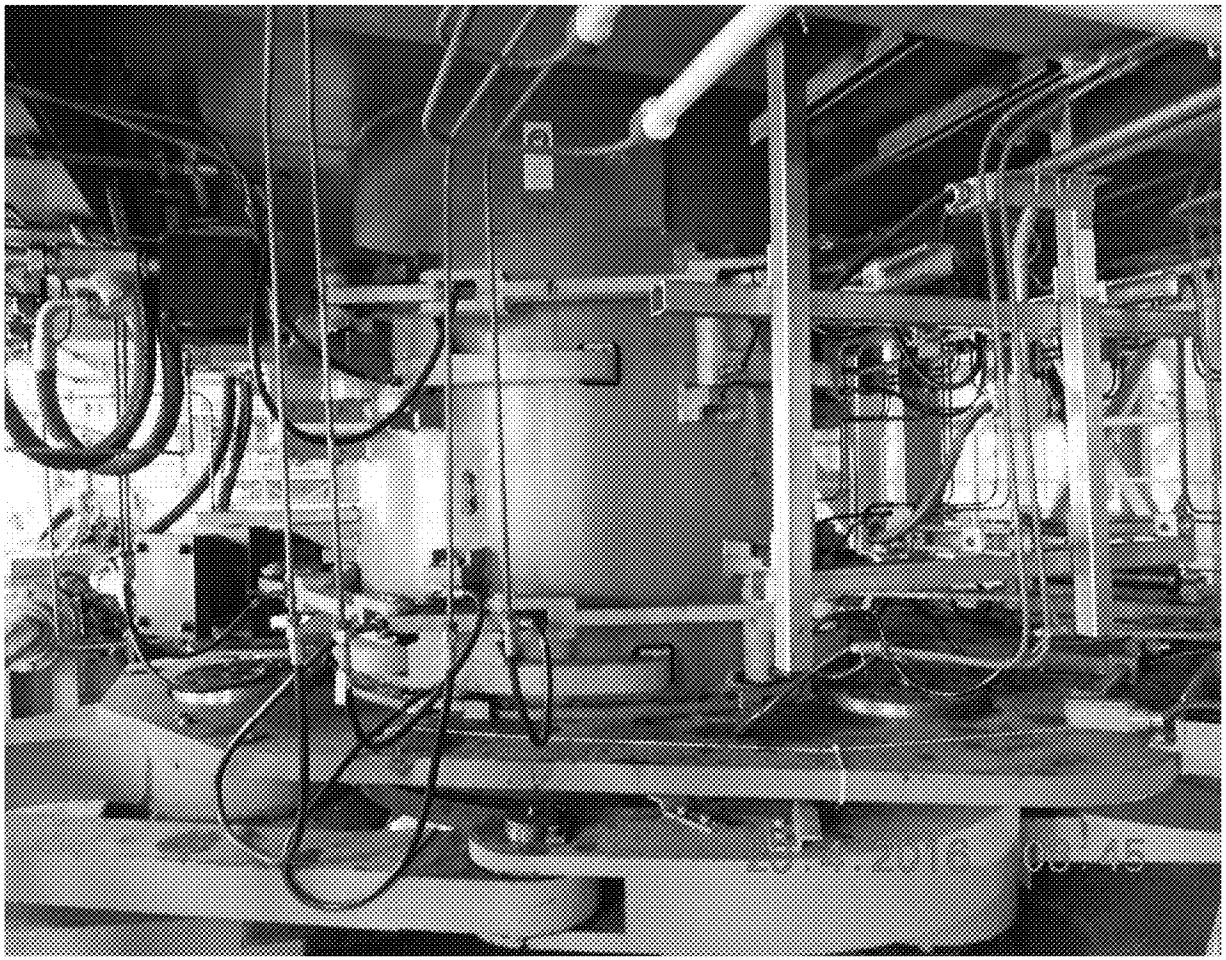
FIG. 5 (PRIOR ART)
FIG. 5 depicts an example of a ferrous mill reform station with a tub shear.
Figure 6:
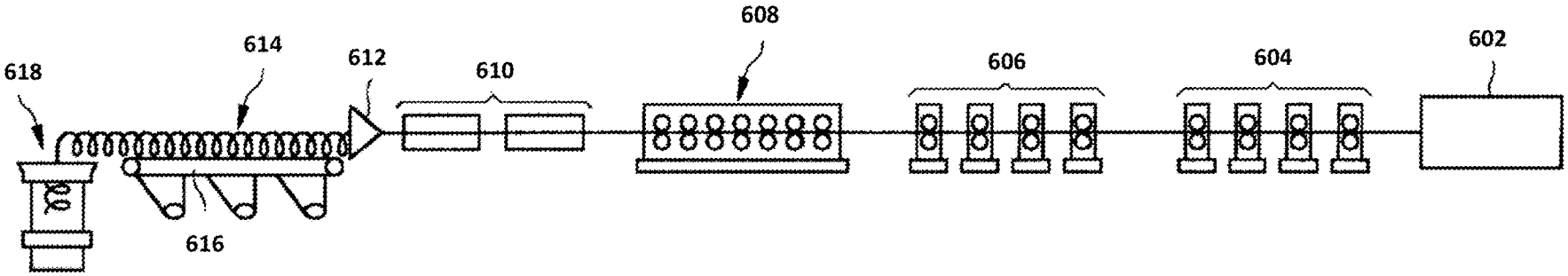
FIG. 6 (PRIOR ART)
FIG. 6 depicts an example of a typical process for forming steel rod in a wire rod mill.
Figure 7C:
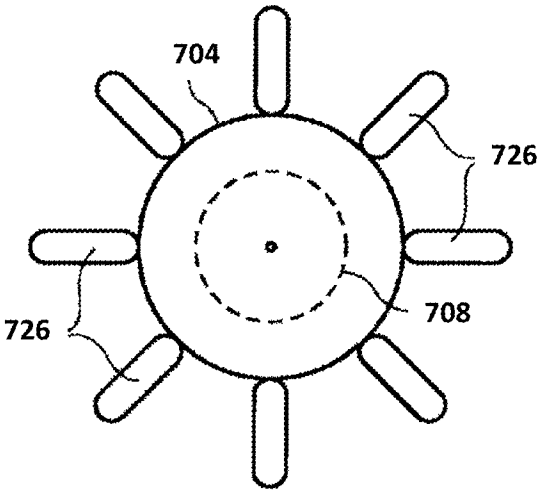
FIG. 7C (PRIOR ART)
FIGS. 7A-7C depict in more detail the reform chamber of FIG. 6.
Figure 7B:
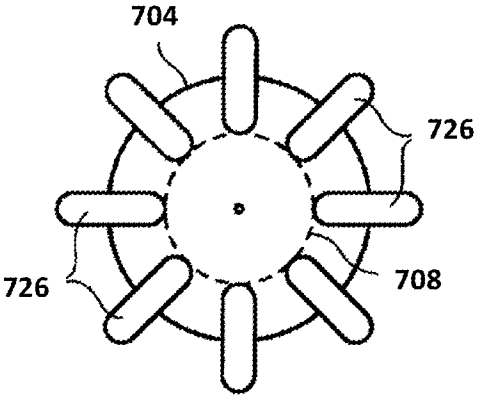
FIG. 7B (PRIOR ART)
Figure 7A:
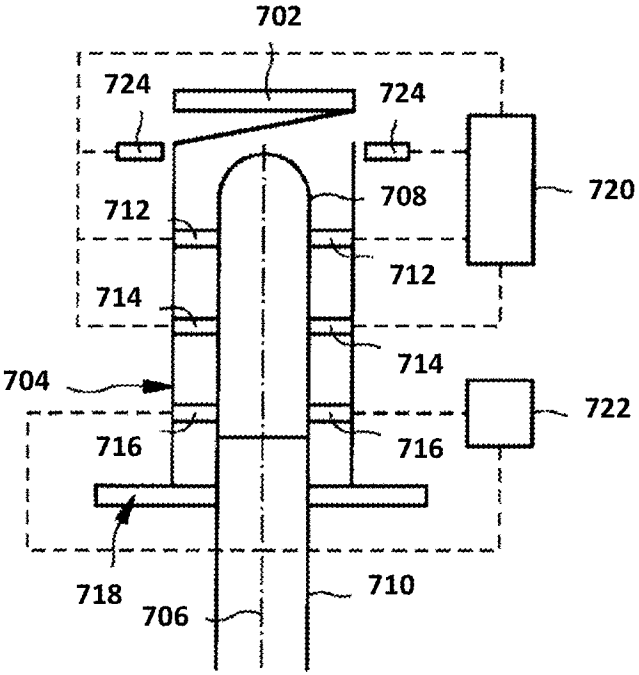
FIG. 7A (PRIOR ART)
Figure 7H:
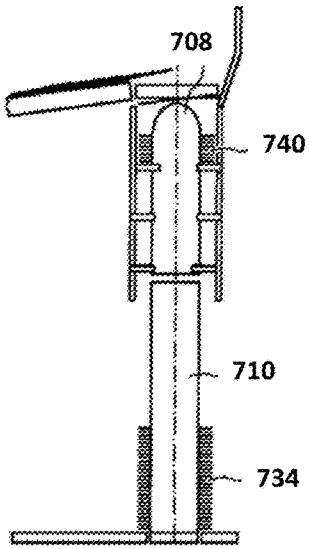
FIG. 7H (PRIOR ART)
Figure 7G:
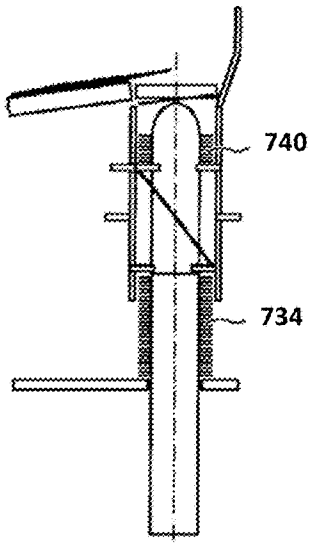
FIG. 7G (PRIOR ART)
Figure 7F:
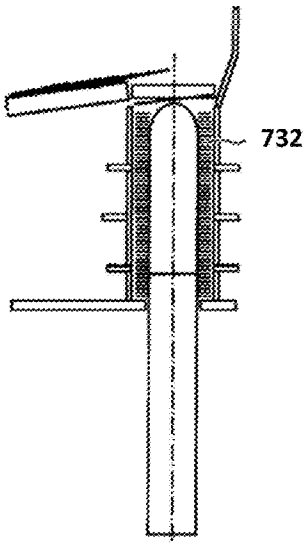
FIG. 7F (PRIOR ART)
Figure 7E:
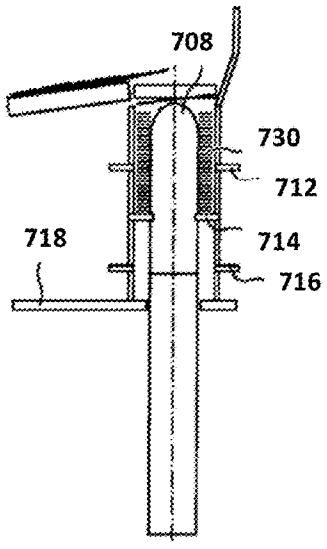
FIG. 7E (PRIOR ART)
Figure 7D:
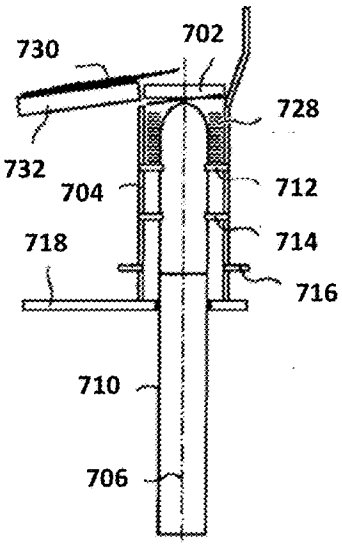
FIG. 7D (PRIOR ART)

While this invention is illustrated and described in a preferred embodiment, the invention may be produced in many different configurations. There is depicted in the drawings, and will herein be described in detail, a preferred embodiment of the invention, with the understanding that the present disclosure is to be considered as an exemplification of the principles of the invention and the associated functional specifications for its construction and is not intended to limit the invention to the embodiment illustrated. Those skilled in the art will envision many other possible variations within the scope of the present invention.

Note that in this description, references to "one embodiment" or "an embodiment" mean that the feature being referred to is included in at least one embodiment of the invention. Further, separate references to "one embodiment" in this description do not necessarily refer to the same embodiment; however, neither are such embodiments mutually exclusive, unless so stated and except as will be readily apparent to those of ordinary skill in the art. Thus, the present invention can include any variety of combinations and/or integrations of the embodiments described herein.

FIGS. 8A through 8H depict one embodiment of the present invention for grabbing a coil beneath a tub shear at the reform end of a wire rod mill, wherein a robot arm 801 is used to convey a cut end of a coil to a feed mechanism or carrier. This arrangement uses a robot with gripper attachment to hold the coil while a horizontal shear cuts the coil. The robot arm may also contain a shear for the purpose of trimming a sample from the end of the rod.

Figure 8B:
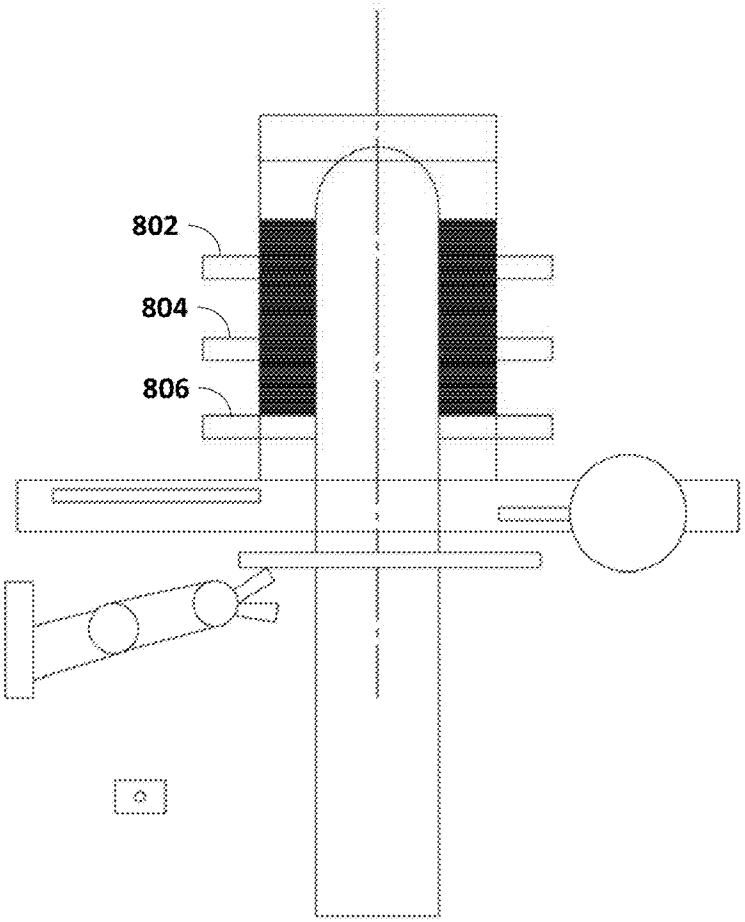
FIGS. 8A-8H depict one embodiment of the present invention for grabbing a coil beneath a tub shear at the reform end of a wire rod mill, wherein a robot arm is used to convey a cut end of a coil to a feed mechanism or carrier.
Figure 8A:
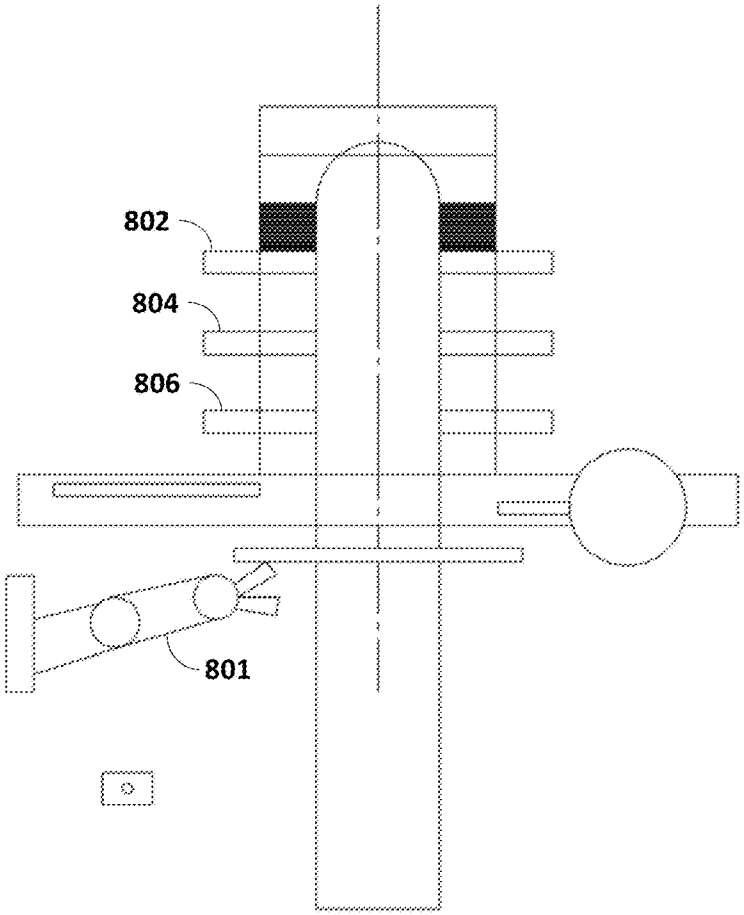

FIG. 8A depicts rings falling into the reforming tub and landing on the uppermost iris 802. The rest of the system is waiting for enough coil to accumulate in order to begin action. This action is determined by coil height which is measured electronically using photo eye height sensors, system timing, or similar.

FIG. 8B depicts rings continuing to accumulate in the tub. The iris(es) 802, 804, and 806 open sequentially (i.e., iris 802 opens first, iris 804 opens second, and iris 806 opens last) as necessary to ensure the coil forms uniformly and does not overflow the tub.

Figure 8D:
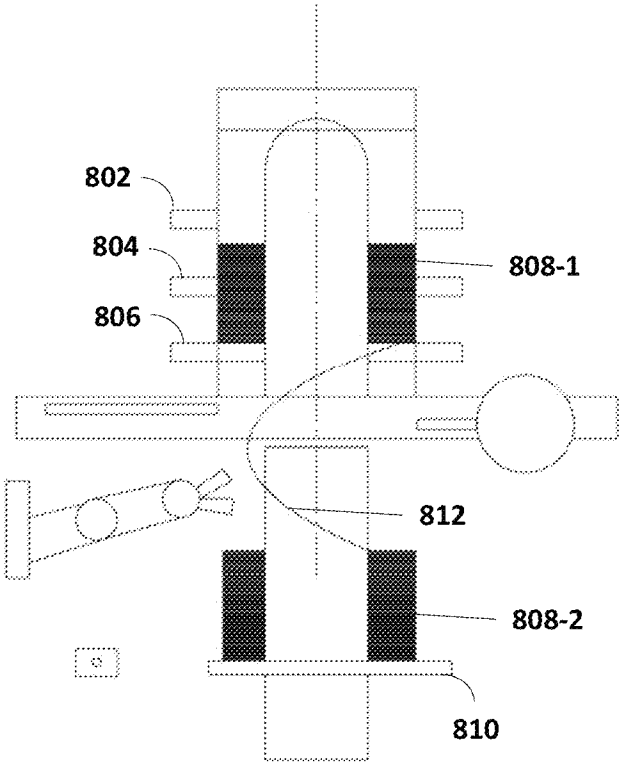
Figure 8C:
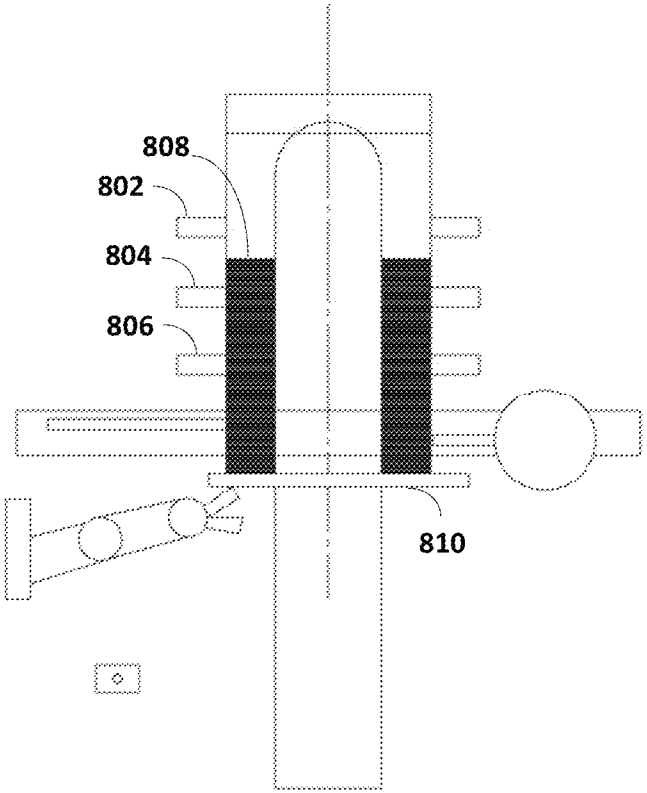

FIG. 8C depicts, when the coil 808 is tall enough, iris 806 opening and dropping the unfinished coil portion 808 onto coilplate 810.

FIG. 8D depicts, when enough coil mass is on coilplate 810 (typically defined by half the coil weight), iris 806 inside the tub closes to create separation between the two halves of the coil 808-1 and 808-2, leaving two separate coil halves connected by a single strand of wire (or umbilicus) 812.

Figure 8F:
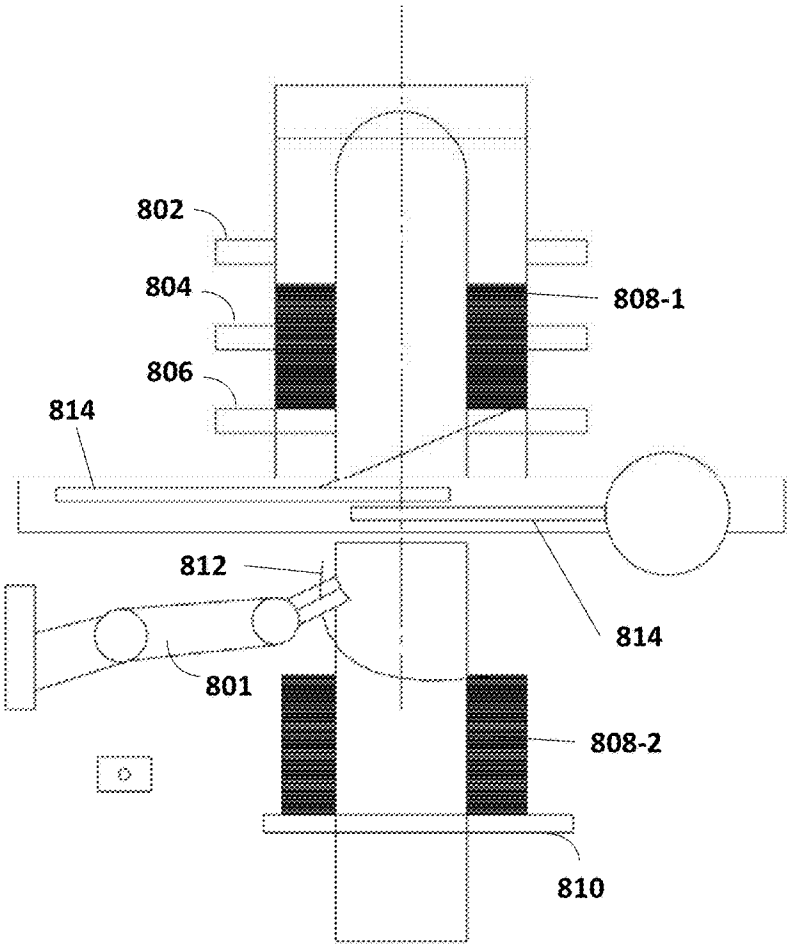
Figure 8E:
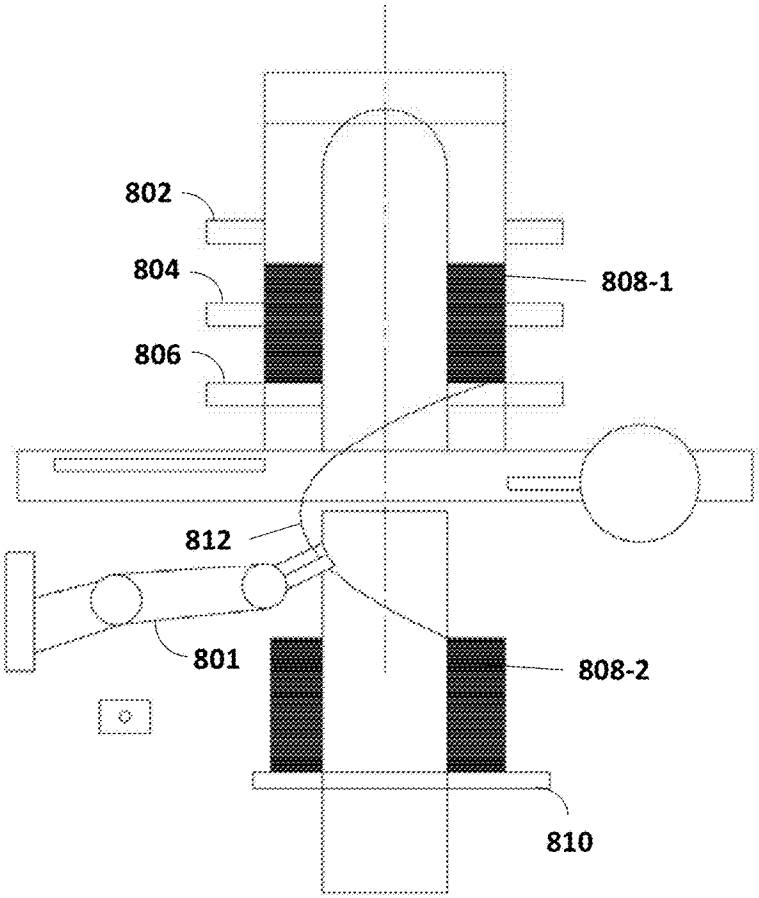

FIG. 8E depicts the robotic arm 801 gripping the wire 812 in preparation for the shear cut. It locates the wire by means of a vision system camera or similar device.

FIG. 8F depicts the horizontal shear 814 mounted below the reform tub severing coil 812. There are now two separate coils one inside the tub 808-1 and one below the tub 808-2.

Figure 8H:
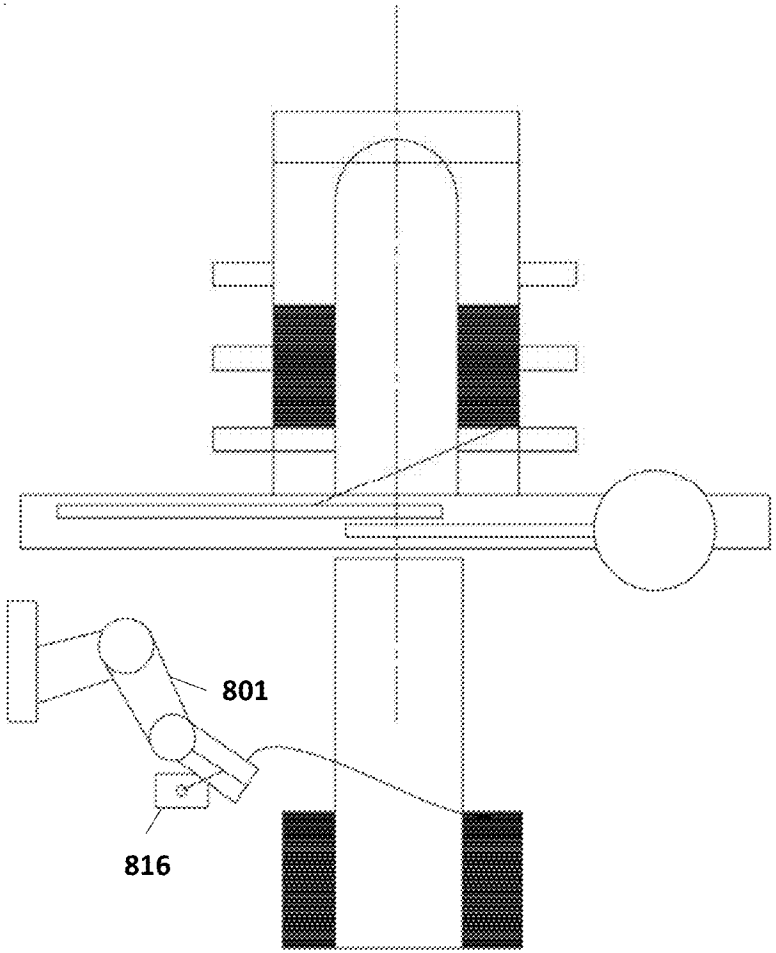
Figure 8G:
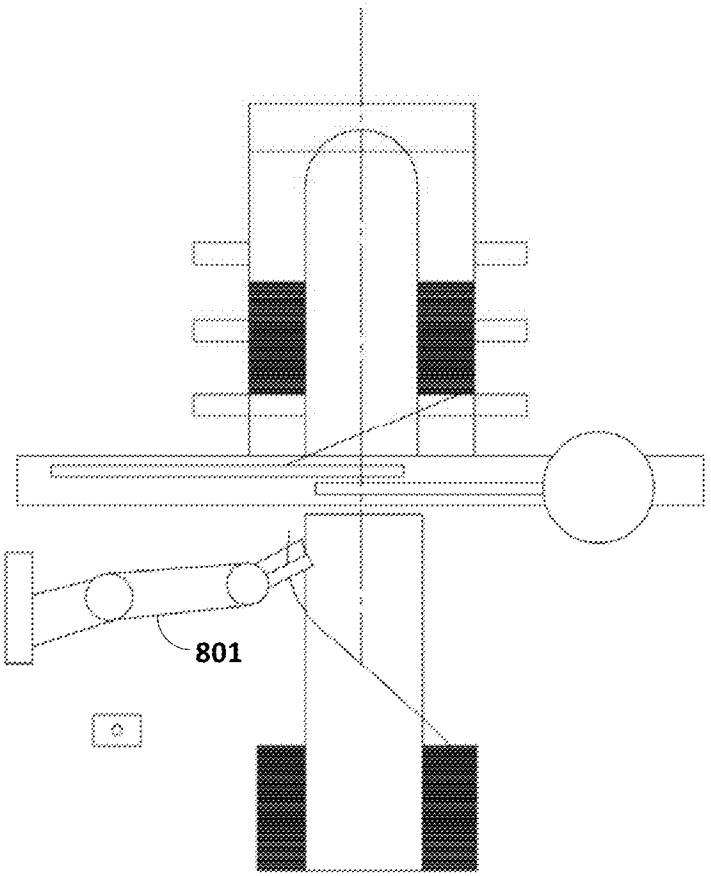

FIG. 8G depicts the robot arm 801 that is left holding the cut coil end. A sample of rod for analysis can be trimmed from the end of the coil at this time if necessary.

FIG. 8H depicts the robot arm 801 delivering the newly severed coil end to a holder or feed mechanism 816. Where the coil end is placed depends on the mill's specific coil handling procedure. The mill may have several different types of holders/feed mechanisms available and the robot may be asked to choose one from the lot depending on input from the mill's central controls on properties such as rod diameter, steel grade, finish temperature, etc. At this time, a sample may be trimmed from the rod either by the robot or the holder mechanism after the rod is placed inside of it by the robot.

In one embodiment, the present invention provides a system comprising: (a) a stem and a nose cone coaxially located above the stem; (b) a reform tub coaxially located with the nose and stem, the reform tub enclosing the nose and at least a portion of the stem; (c) at least one retractable iris mounted to the reform tub; (d) a retractable shear mounted to the reform tub and located underneath the retractable iris; (e) a coil plate located underneath the retractable shear; and (f) a robotic arm positioned underneath the retractable shear. In this embodiment: (1) the controller sets the retractable iris to engage the nose while holding a coil within the reform tub, and upon the coil attaining a pre-determined height, the controller retracts, for a pre-determined time period, the retractable iris to no longer engage the nose wherein, upon such retraction for the pre-determined time period (e.g., until ½ of the coil height falls to the coil plate), a portion of the coil falls to the coil plate; (2) after expiration of the pre-determined time period (e.g., until ½ of the coil height falls to the coil plate), the controller sets the retractable iris to engage the nose where a remainder of the coil is held within the reform tub; (3) the controller sets the retractable shear to not impede with the portion of the coil or the remainder of the coil, wherein the portion of the coil and the remainder of the coil are separated by an umbilical cord, (4) the controller sets the retractable shear to sever the umbilical cord, and (5) the controller sends one or more instructions to the robotic arm to convey a severed end of the umbilical cord to a feed mechanism or a carrier.

In this embodiment, the present invention provides a method as implemented in a reform station unit of a wire rod mill system, the reform station unit comprising: a stem and a nose cone coaxially located above the stem; a reform tub coaxially located with the nose and stem, the reform tub enclosing the nose and at least a portion of the stem; at least one retractable iris mounted to the reform tub; a retractable shear mounted to the reform tub and located underneath the retractable iris; a coil plate located underneath the retractable shear; and a robotic arm positioned underneath the retractable shear, the method comprising the steps of: (a) setting the retractable iris to engage the nose while holding a coil within the reform tub, and upon the coil attaining a pre-determined height, the controller retracting, for a pre-determined time period, the retractable iris to no longer engage the nose wherein, upon such retraction for the pre-determined time period, a portion of the coil falls to the coil plate; (b) after expiration of the pre-determined time period, setting the retractable iris to engage the nose where a remainder of the coil is held within the reform tub; (c) setting the retractable shear to not impede with the portion of the coil or the remainder of the coil, wherein the portion of the coil and the remainder of the coil are separated by an umbilical cord; (d) setting the retractable shear to sever the umbilical cord, and (e) sending one or more instructions to the robotic arm to convey a severed end of the umbilical cord to a feed mechanism or a carrier.

FIGS. 9A through 9F depict another embodiment of the present invention that uses robot arm 901 for conveying the cut while using a set of pincers to position the coil for cutting with a shear mounted on the robot arm. This arrangement uses the robot to both grip/manipulate the coil and shear the coil. The robot is mounted with a combination tool that allows it to hold the rod and cut the rod.

Figure 9A:
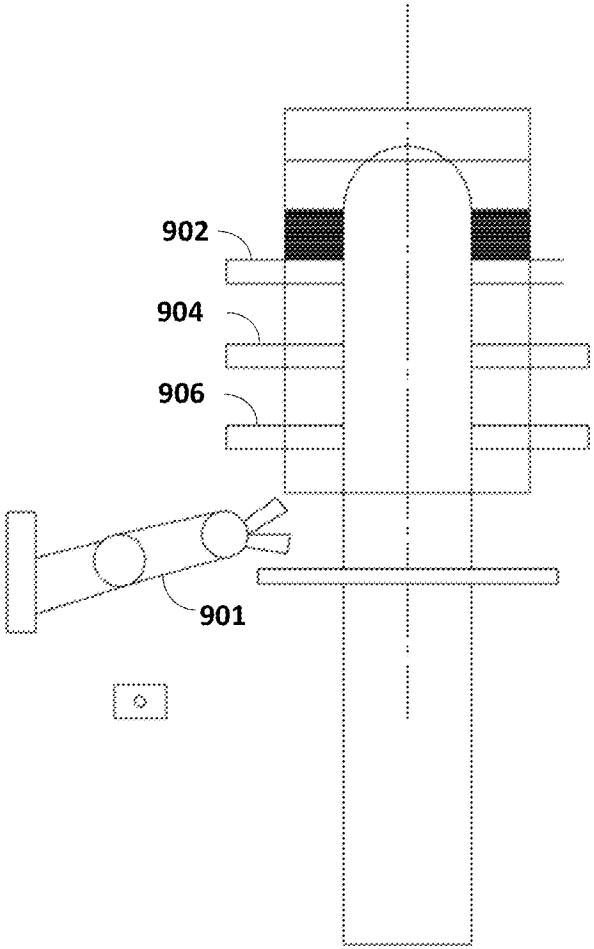
FIGS. 9A-9F depict another embodiment of the present invention that uses a robot arm for conveying the cut while using a set of pincers to position the coil for cutting with a shear mounted on the robot arm.

FIG. 9A depicts rings falling into the reforming tub and landing on the uppermost iris 902. The rest of the system is waiting for enough coil to accumulate in order to begin action. This action is determined by coil height which is measured electronically using photo eye height sensors, system timing, or similar.

Figure 9B:
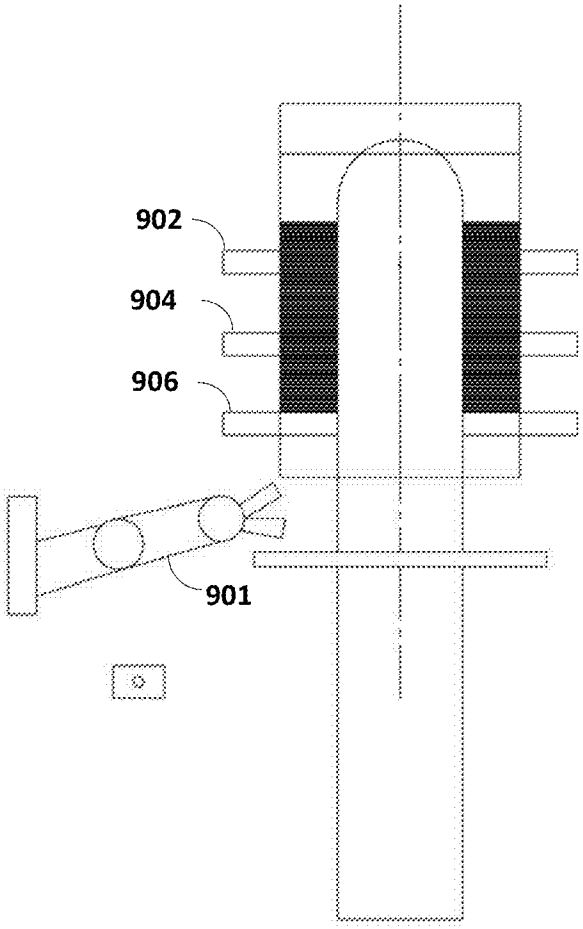

FIG. 9B depicts rings continuing to accumulate in the tub. Iris(es) 902, 904, and 906 open sequentially (i.e., iris 902 opens first, iris 904 opens second, and iris 906 opens last) as necessary to ensure the coil forms uniformly and does not overflow the tub.

Figure 9D:
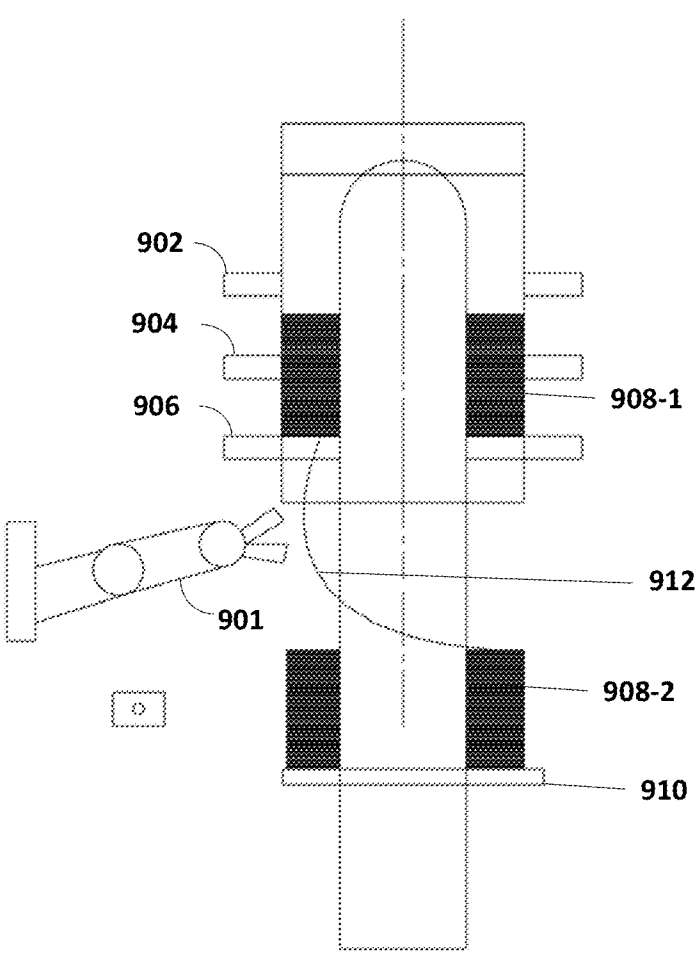
Figure 9C:
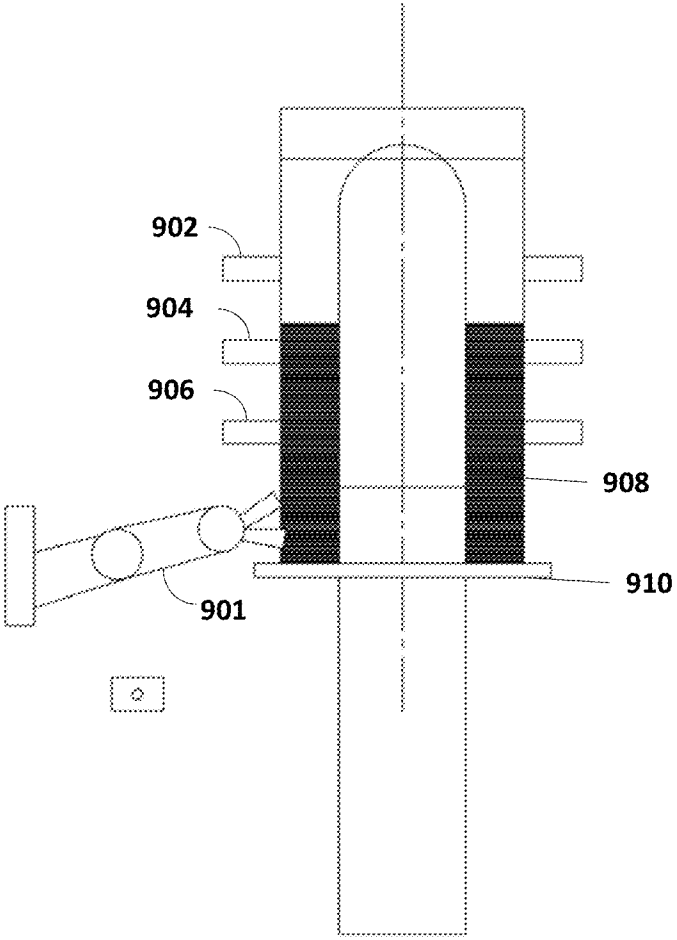

FIG. 9C depicts, when the coil 908 is tall enough, iris 906 opening and dropping the unfinished coil portion 908 onto the coilplate 910.

FIG. 9D depicts, when enough coil mass is on the coilplate 910 (typically defined by half the coil weight), iris 906 inside the tub closes to create separation between the two halves of the coil 908-1 and 908-2, leaving two separate coil halves connected by a single strand of wire (or umbilicus) 912.

Figure 9F:
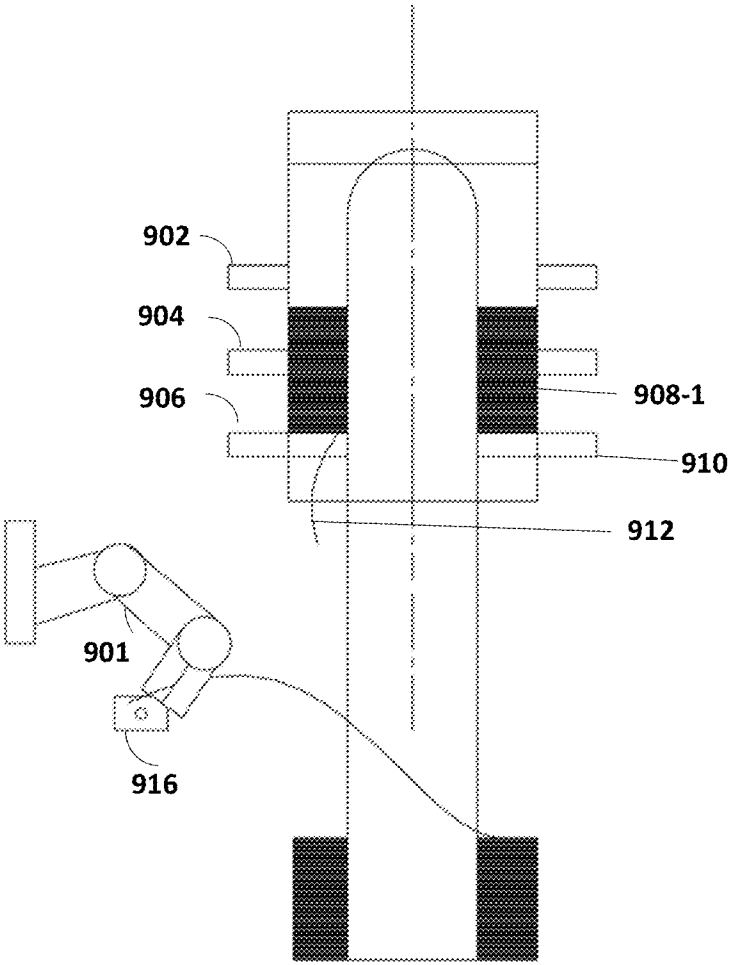
Figure 9E:
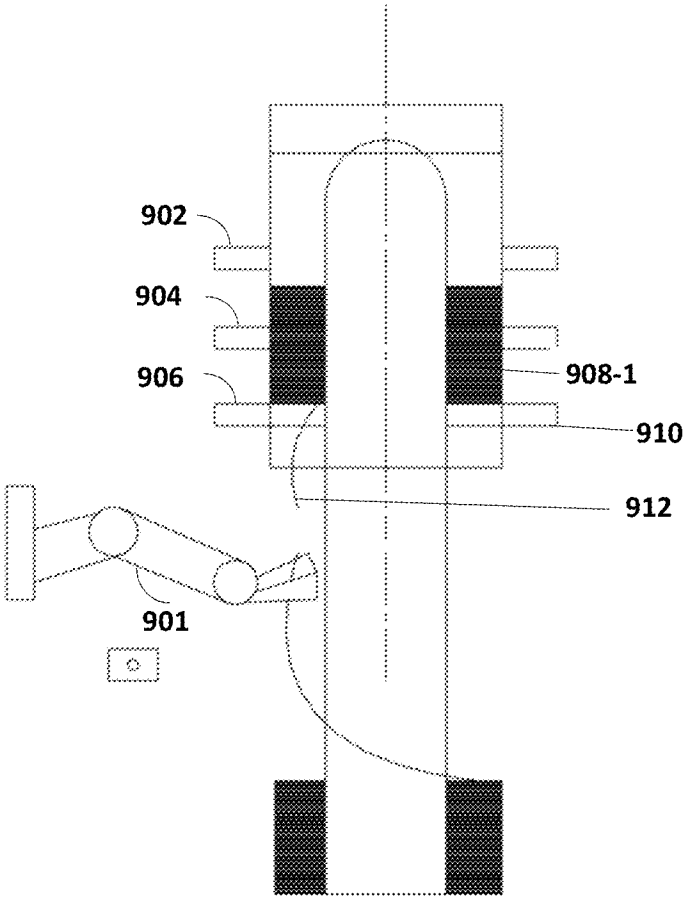

FIG. 9E depicts the robotic arm 901 gripping the wire 912 in preparation for the shear cut. The shear mounted on the end of the robot arm 901 cuts the coil at the indicated location. The two halves of the coil are now separate, and the robot arm 901 is left gripping the end of the newly formed coil on the mandrel stem.

FIG. 9F depicts the robot arm 901 delivering the newly severed coil end to a holder or feed mechanism 916. Where the coil end is placed depends on the mill's specific coil handling procedure. The mill may have several different types of holders/feed mechanisms available and the robot may be asked to choose one from the lot depending on input from the mill's central controls on properties such as rod diameter, steel grade, finish temperature, etc.

In this embodiment, the present invention provides a system comprising: (a) a stem and a nose cone coaxially located above the stem; (b) a reform tub coaxially located with the nose and stem, the reform tub enclosing the nose and at least a portion of the stem; (c) at least one retractable iris mounted to the reform tub; (d) a robotic arm with a shear mounted thereon and a set of pincers, the robotic arm and the pincers located beneath the retractable iris; and (e) a coil plate located underneath the robotic arm. In this embodiment: (1) the controller sets the retractable iris to engage the nose while holding a coil within the reform tub, and upon the coil attaining a pre-determined height, the controller retracts, for a pre-determined time period, the retractable iris to no longer engage the nose wherein, upon such retraction for the pre-determined time period (e.g., until ½ of the coil height falls to the coil plate), a portion of the coil falls to the coil plate; (2) after expiration of the pre-determined time period (e.g., until ½ of the coil height falls to the coil plate), the controller sets the retractable iris to engage the nose while holding a remainder of the coil within the reform tub; (3) the controller sets the robotic arm and the set of pincers to not impede with the portion of the coil or the remainder of the coil, wherein the portion of the coil and the remainder of the coil are separated by an umbilical cord; (4) the controller sends instructions to the set of pincers to position the umbilical cord for shearing; (5) the controller sends instructions to the robotic arm to sever the umbilical cord using the shear mounted thereon, and (6) the controller sends instructions to the robotic arm to convey a severed end of the umbilical cord to a feed mechanism or a carrier.

In this embodiment, the present invention provides a method as implemented in a reform station unit of a wire rod mill system, the reform station unit comprising: a stem and a nose cone coaxially located above the stem, a reform tub coaxially located with the nose and stem, the reform tub enclosing the nose and at least a portion of the stem, at least one retractable iris mounted to the reform tub, a robotic arm with a shear mounted thereon and a set of pincers, the robotic arm and the pincers located beneath the retractable iris, and a coil plate located underneath the robotic arm, the method comprising the steps of: (a) setting the retractable iris to engage the nose while holding a coil within the reform tub, and upon the coil attaining a pre-determined height, the controller retracting, for a pre-determined time period, the retractable iris to no longer engage the nose wherein, upon such retraction for the pre-determined time period, a portion of the coil falls to the coil plate; (b) after expiration of the pre-determined time period, setting the retractable iris to engage the nose while holding a remainder of the coil within the reform tub; (c) setting the robotic arm and the set of pincers to not impede with the portion of the coil or the remainder of the coil, wherein the portion of the coil and the remainder of the coil are separated by an umbilical cord; (d) sending instructions to the set of pincers to position the umbilical cord for shearing; (e) sending instructions to the robotic arm to sever the umbilical cord using the shear mounted thereon; and (f) sending instructions to the robotic arm to convey a severed end of the umbilical cord to a feed mechanism or a carrier.

FIGS. 10A through 10G depict yet another embodiment of the present invention that uses three (3) robot arms 1001-1, 1001-2 and 1001-3, two for separating the coil and one for shearing/conveying or, optionally, using four robot arms (not shown), two for separating the coil, one for shearing, and one for conveying. This arrangement can have variable numbers of robot arms depending on how the mill wants to process the coil. The robot arms can individually be mounted with any arrangement of gripper tools, shearing tools, or combination tools that both grip and shear the bar at once, or any other type of specialty tool useful for completing the coil cutting and handling process. The robots can be arranged symmetrically or radially around the tub, or in any other suitable arrangement, depending on the mill's unique needs, as long as the robots do not interfere with each other or with the movement of the coils.

Figure 10B:
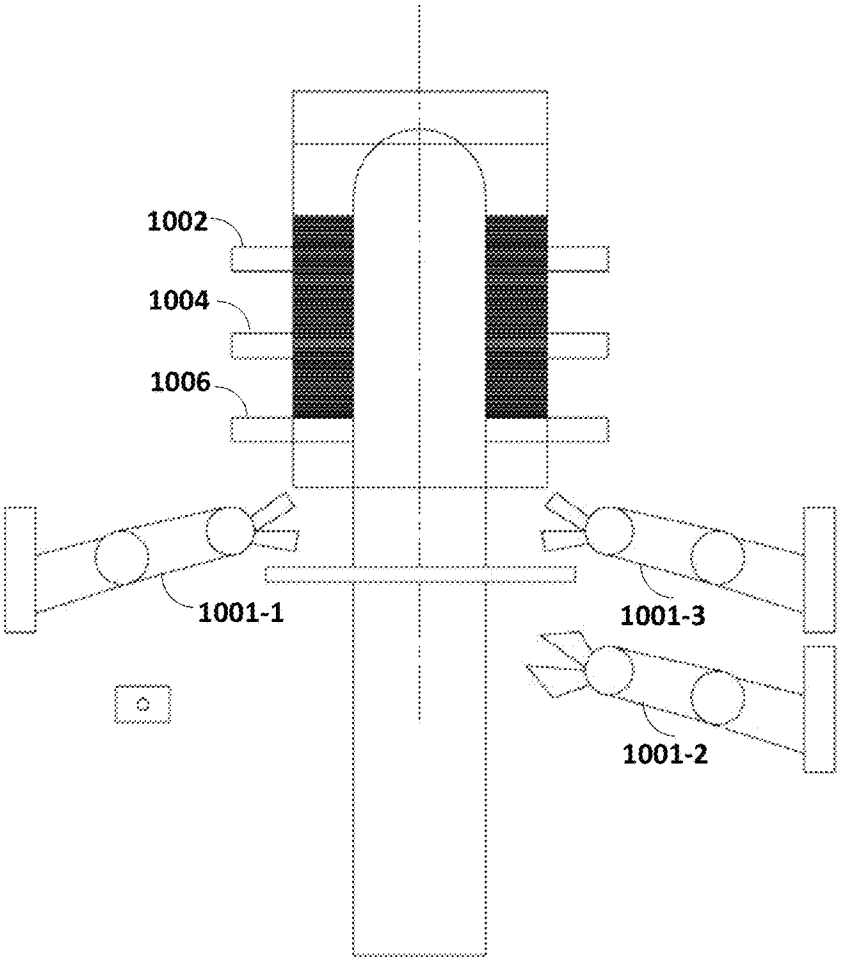
FIGS. 10A-10G depict yet another embodiment of the present invention that uses three (3) robot arms, two for separating the coil and one for shearing/conveying or, optionally, using four robot arms, two for separating the coil, one for shearing, and one for conveying.
Figure 10A:
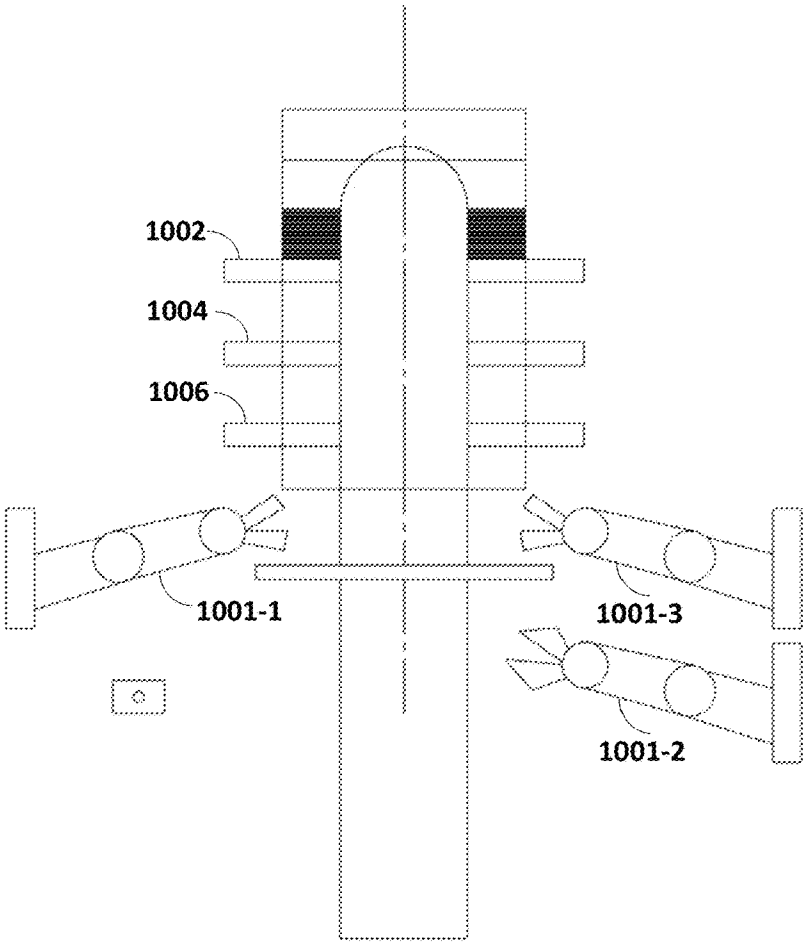

FIG. 10A depicts rings falling into the reforming tub and land on the uppermost iris 1002. The rest of the system is waiting for enough coil to accumulate in order to begin action. This action is determined by coil height which is measured electronically using photo eye height sensors, system timing, or similar.

FIG. 10B depicts rings continuing to accumulate in the tub. The iris(es) 1002, 1004 and 1006 open sequentially (i.e., iris 1002 opens first, iris 1004 opens second, and iris 1006 opens last) as necessary to ensure the coil forms uniformly and does not overflow the tub.

Figure 10D:
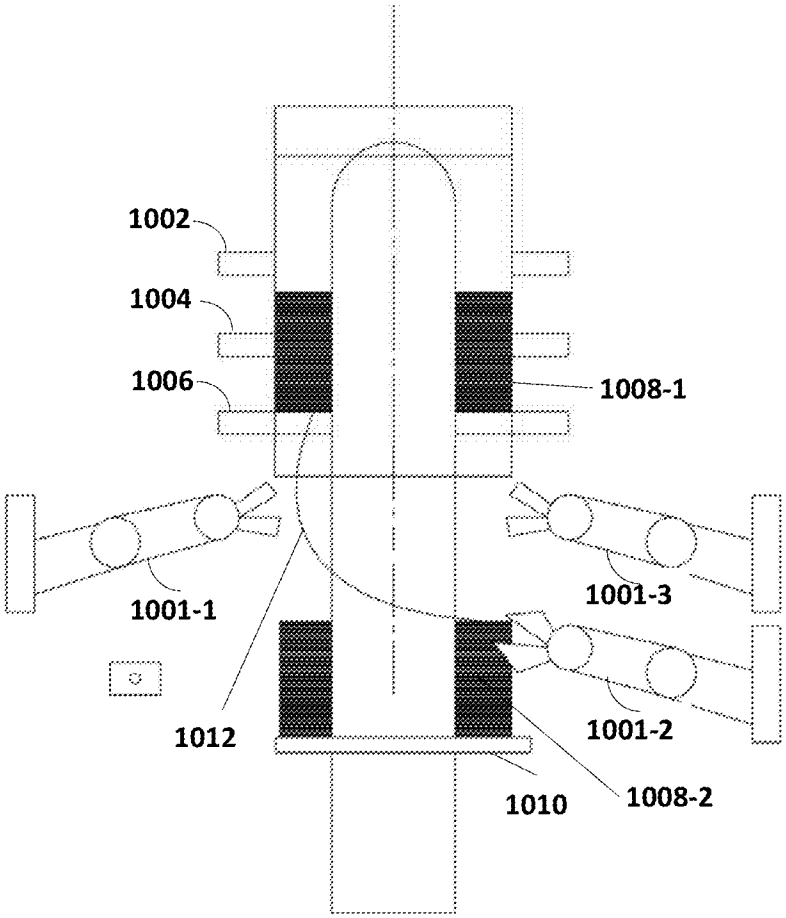
Figure 10C:
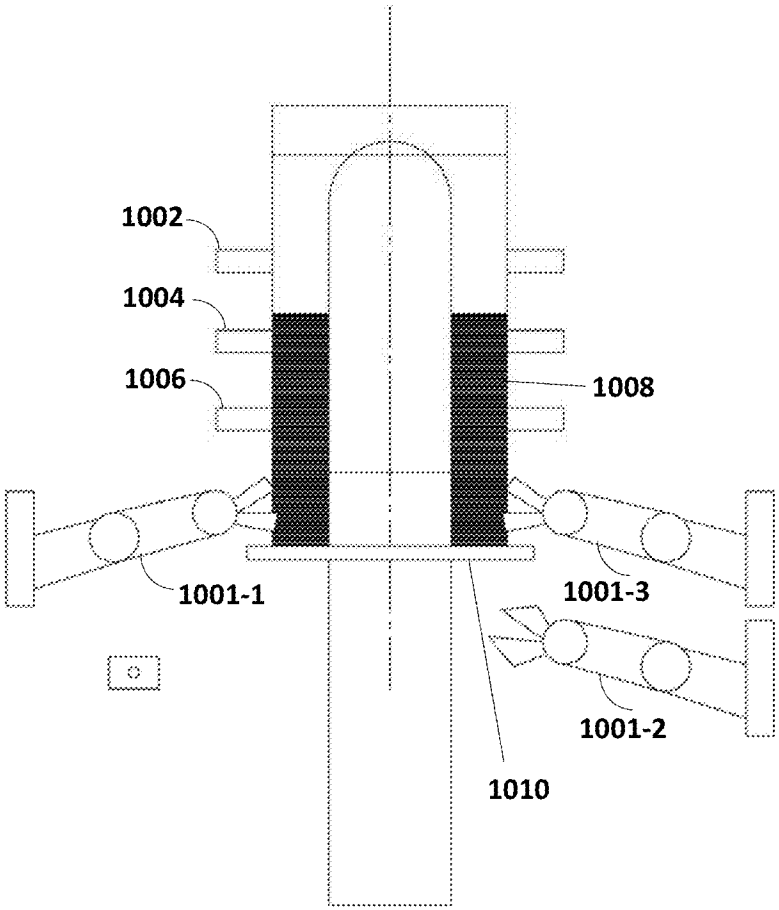

FIG. 10C depicts, when the coil 1008 is tall enough, iris 1006 opening and dropping the unfinished coil portion onto the coilplate 1010.

FIG. 10D depicts, when enough coil mass is on the coilplate 1010 (typically defined by half the coil weight), iris 1006 inside the tub closing to create separation between the two halves of the coil 1008-1 and 1008-2, leaving two separate coil halves connected by a single strand of wire (or umbilicus) 1012.

Figure 10F:
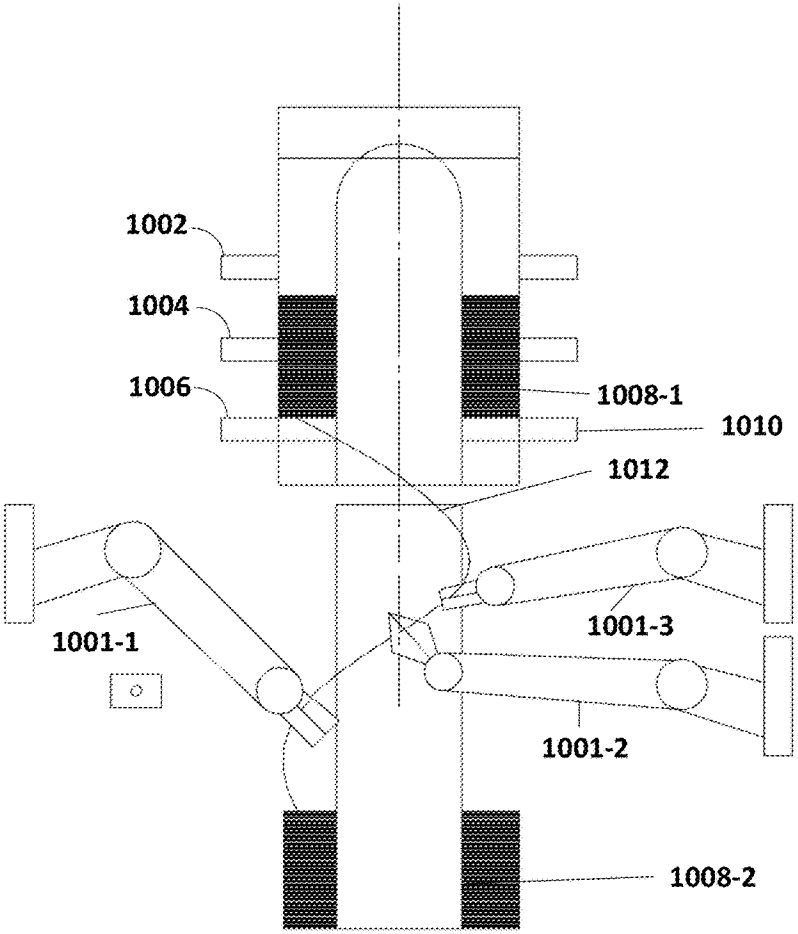
Figure 10E:
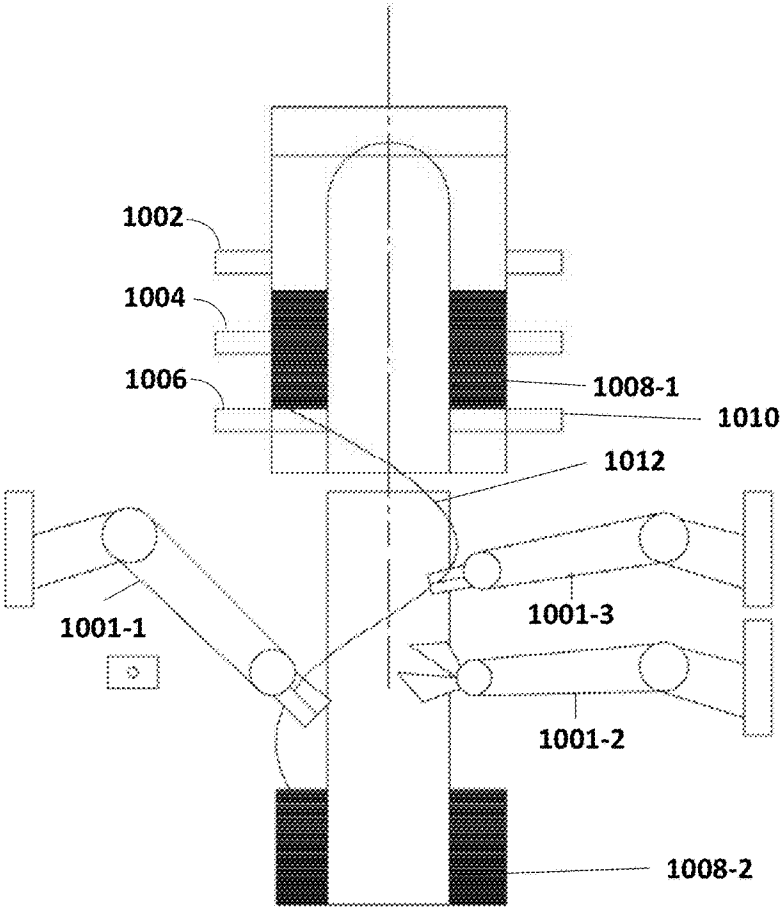

FIG. 10E depicts two of the robot arms 1001-1 and 1001-3 (the gripper robots) gripping the umbilical wire 1012 at strategic locations chosen according to the wire's current position (relative to the mandrel stem and shearing robot) and positioning the wire 1012 at an optimal location for the upcoming shear cut.

FIG. 10F depicts the shearing robot 1001-2 moving in and cutting the wire 1012. The position can be determined from feedback from a vision camera system, relative positions of the other robots, or similar arrangements.

Figure 10G:
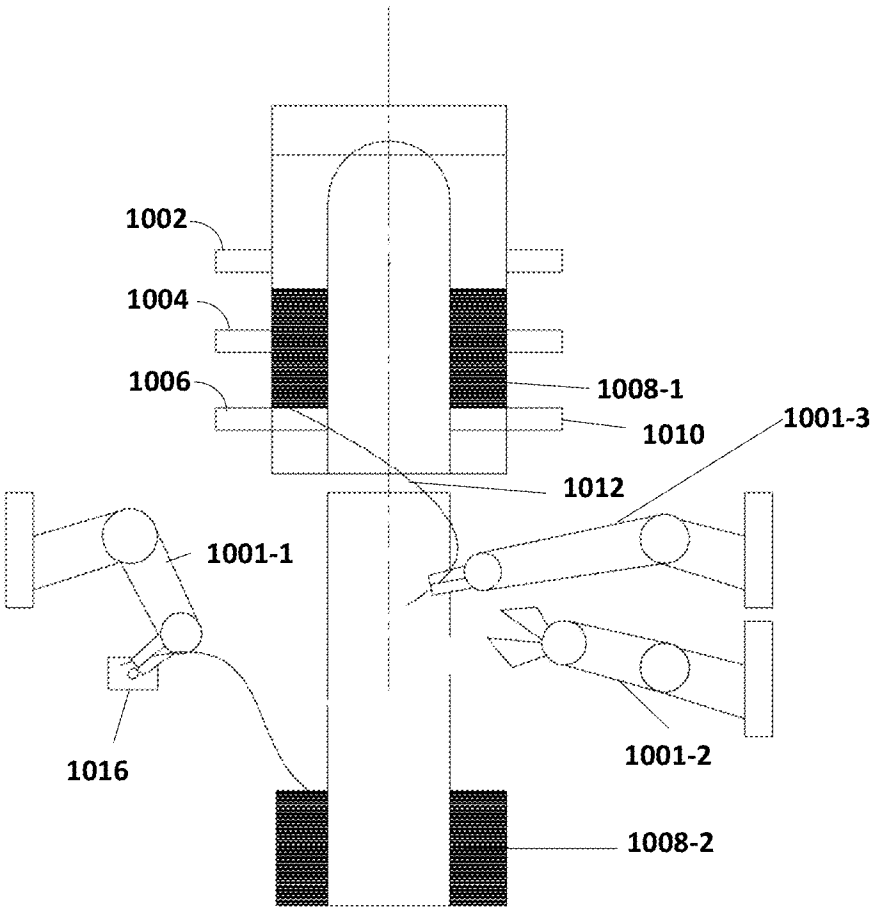

FIG. 10G depicts the coil that is now separated into two halves 1008-1 and 1008-2. A gripper robot 1001-1 and 1001-3 maintains hold on each half. At this time, a sample may be trimmed from the coil end by one or more of the robot arms before the robot holding the coil tail end conveys it to a holder or feed mechanism 1016. Where exactly the coil end is placed depends on the mill's specific coil handling procedure. The mill may have several different types of holders/feed mechanisms available and the robot may be asked to choose one from the lot depending on input from the mill's central controls on properties such as rod diameter, steel grade, finish temperature, etc.

In this embodiment, the present invention provides a system comprising: (a) a stem and a nose cone coaxially located above the stem; (b) a reform tub coaxially located with the nose and stem, the reform tub enclosing the nose and at least a portion of the stem; (c) at least one retractable iris mounted to the reform tub; (d) a first robotic arm with a shear mounted thereon, the robotic arm located beneath the retractable iris; (e) a second robotic arm and a third robotic arm for positioning coils; and (f) a coil plate located underneath the first, second, and third robotic arms.

In this embodiment: (1) the controller sets the retractable iris to engage the nose while holding a coil within the reform tub, and upon the coil attaining a pre-determined height, the controller retracts, for a pre-determined time period, the retractable iris to no longer engage the nose wherein, upon such retraction for the pre-determined time period, a portion of the coil falls to the coil plate; (2) after expiration of the pre-determined time period, the controller sets the retractable iris to engage the nose while holding a remainder of the coil within the reform tub; (3) the controller sets the first, second and third robotic arms to not impede with the portion of the coil or the remainder of the coil, wherein the portion of the coil and the remainder of the coil are separated by an umbilical cord; (4) the controller sends instructions to the second and third robotic arms to position the umbilical cord for shearing; (5) the controller sends instructions to the first robotic arm to sever the umbilical cord using the shear mounted thereon, and (6) the controller sends instructions to the first robotic arm to convey a severed end of the umbilical cord to a feed mechanism or a carrier.

According to this embodiment, the present invention provides a method as implemented in a reform station unit of a wire rod mill system, the reform station unit comprising: a stem and a nose cone coaxially located above the stem, a reform tub coaxially located with the nose and stem, the reform tub enclosing the nose and at least a portion of the stem, at least one retractable iris mounted to the reform tub, a first robotic arm with a shear mounted thereon, the robotic arm located beneath the retractable iris, a second robotic arm and a third robotic arm for positioning coils, and a coil plate located underneath the first, second, and third robotic arms, the method comprising the steps of: (a) setting the retractable iris to engage the nose while holding a coil within the reform tub, and upon the coil attaining a pre-determined height, the controller retracting, for a pre-determined time period, the retractable iris to no longer engage the nose wherein, upon such retraction for the pre-determined time period, a portion of the coil falls to the coil plate; (b) after expiration of the pre-determined time period, setting the retractable iris to engage the nose while holding a remainder of the coil within the reform tub; (c) setting the first, second and third robotic arms to not impede with the portion of the coil or the remainder of the coil, wherein the portion of the coil and the remainder of the coil are separated by an umbilical cord; (d) sending instructions to the second and third robotic arms to position the umbilical cord for shearing; (e) sending instructions to the first robotic arm to sever the umbilical cord using the shear mounted thereon, and (f) sending instructions to the first robotic arm to convey a severed end of the umbilical cord to a feed mechanism or a carrier.

Figure 11B:
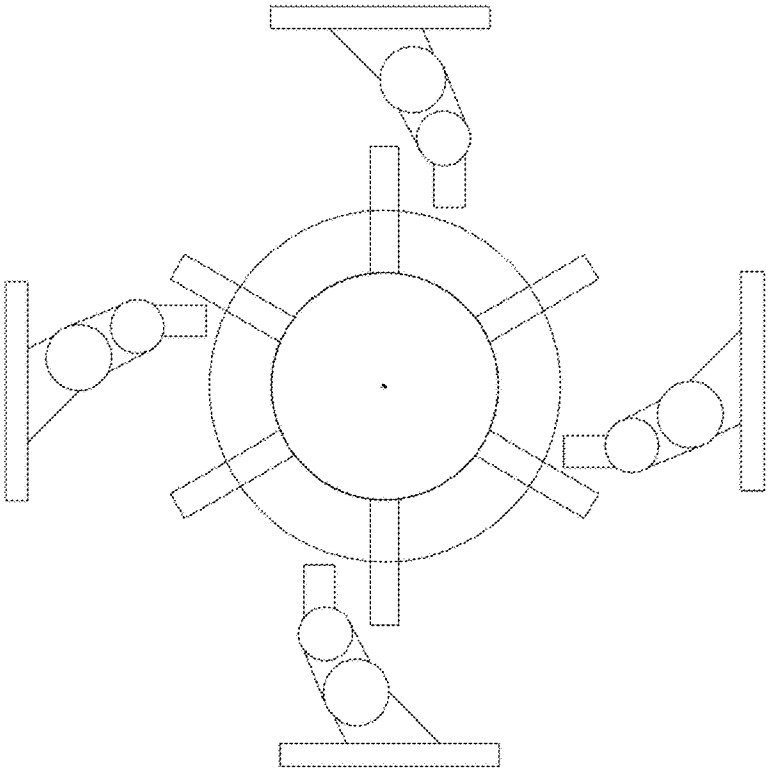
FIGS. 11A-11B depict sample arrangements showing a setup with 3 robot arms and a setup with 4 robot arms, respectively.
Figure 11A:
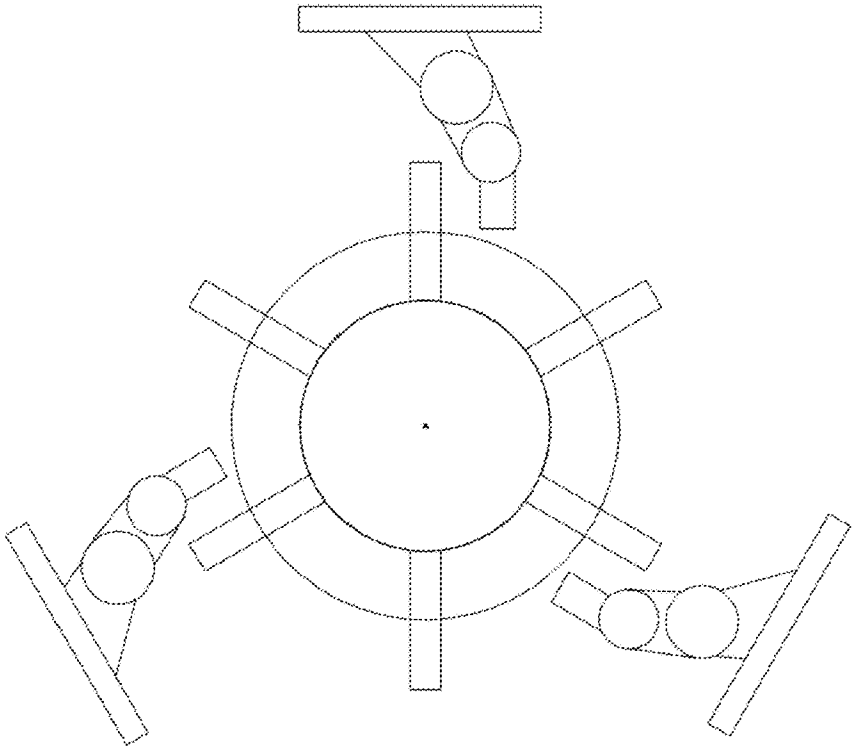

FIG. 11A depicts sample arrangements showing a setup with 3 robot arms.

FIG. 11B depicts sample arrangement showing a setup with 4 robot arms.

On non-ferrous mills, the present invention's system and method would completely eliminate the problem of manual cutting of the umbilical cord, sample taking and wrapping of the loose ends. It would provide a consistent process and eliminate potential safety hazards. On ferrous mills, the system would provide a cost-effective alternative to reform tub shears and be retrofittable to many existing coil reforming stations.

The present invention's system and method also incorporates within the coil forming process, strategic use of sensors, vision systems, robotics, etc.

The present invention's system and method has the capability to handle a wide range of sizes and grades. The present invention's system and method is also able to perform shearing, conveying, etc. within a window of time that does not affect the cycle time of the coil forming operation.

The present invention's system provides an automatic function for severing the umbilical cord rather than a risky, manual operation. This provides a more efficient and consistent operation in the case of non-ferrous products. In the case of ferrous coil-separation, the present invention provides a less mechanically involved system.

The logical operations of robotic arms in the various embodiments are implemented as: (1) a sequence of computer implemented steps, operations, or procedures running on a programmable circuit within a general use computer, (2) a sequence of computer implemented steps, operations, or procedures running on a specific-use programmable circuit; and/or (3) interconnected machine modules or program engines within the programmable circuits.

The above-described features associated with the logical operations of the robotic arms in the various embodiments may be implemented as software processes that are specified as a set of instructions recorded on a computer readable storage medium (also referred to as computer readable medium). When these instructions are executed by one or more processing unit(s) (e.g., one or more processors, cores of processors, or other processing units), they cause the processing unit(s) to perform the actions indicated in the instructions. Embodiments within the scope of the present disclosure may also include tangible and/or non-transitory computer-readable storage media for carrying or having computer-executable instructions or data structures stored thereon. Such non-transitory computer-readable storage media can be any available media that can be accessed by a general purpose or special purpose computer, including the functional design of any special purpose processor. By way of example, and not limitation, such non-transitory computer-readable media can include flash memory, RAM, ROM, EEPROM, CD-ROM or other optical disk storage, magnetic disk storage or other magnetic storage devices, or any other medium which can be used to carry or store desired program code means in the form of computer-executable instructions, data structures, or processor chip design. The computer readable media does not include carrier waves and electronic signals passing wirelessly or over wired connections.

Computer-executable instructions include, for example, instructions and data which cause a general purpose computer, special purpose computer, or special purpose processing device to perform a certain function or group of functions. Computer-executable instructions also include program modules that are executed by computers in standalone or network environments. Generally, program modules include routines, programs, components, data structures, objects, and the functions inherent in the design of special-purpose processors, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing or executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks.

In this specification, the term "software" is meant to include firmware residing in read-only memory or applications stored in magnetic storage or flash storage, for example, a solid-state drive, which can be read into memory for processing by a processor. Also, in some implementations, multiple software technologies can be implemented as sub-parts of a larger program while remaining distinct software technologies. In some implementations, multiple software technologies can also be implemented as separate programs. Finally, any combination of separate programs that together implement a software technology described here is within the scope of the subject technology. In some implementations, the software programs, when installed to operate on one or more electronic systems, define one or more specific machine implementations that execute and perform the operations of the software programs.

A computer program (also known as a program, software, software application, script, or code) can be written in any form of programming language, including compiled or interpreted languages, declarative or procedural languages, and it can be deployed in any form, including as a standalone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

These functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, for example microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic or solid state hard drives, read-only and recordable Blu-Ray® discs, ultra density optical discs, any other optical or magnetic media, and floppy disks. The computer-readable media can store a computer program that is executable by at least one processing unit and includes sets of instructions for performing various operations. Examples of computer programs or computer code include machine code, for example is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, for example application specific integrated circuits (ASICs) or field programmable gate arrays (FPGAs). In some implementations, such integrated circuits execute instructions that are stored on the circuit itself.

It is understood that any specific order or hierarchy of steps in the processes disclosed is an illustration of example approaches. Based upon design preferences, it is understood that the specific order or hierarchy of steps in the processes may be rearranged, or that all illustrated steps be performed. Some of the steps may be performed simultaneously. For example, in certain circumstances, multitasking and parallel processing may be advantageous. Moreover, the separation of various system components illustrated above should not be understood as requiring such separation, and it should be understood that the described program components and systems can generally be integrated together in a single software product or packaged into multiple software products.

Various modifications to these aspects will be readily apparent, and the generic principles defined herein may be applied to other aspects. Thus, the claims are not intended to be limited to the aspects shown herein, but is to be accorded the full scope consistent with the language claims, where reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject technology.

A phrase, for example, an "aspect" does not imply that the aspect is essential to the subject technology or that the aspect applies to all configurations of the subject technology. A disclosure relating to an aspect may apply to all configurations, or one or more configurations. A phrase, for example, an aspect may refer to one or more aspects and vice versa. A phrase, for example, a "configuration" does not imply that such configuration is essential to the subject technology or that such configuration applies to all configurations of the subject technology. A disclosure relating to a configuration may apply to all configurations, or one or more configurations. A phrase, for example, a configuration may refer to one or more configurations and vice versa.

The various embodiments described above are provided by way of illustration only and should not be construed to limit the scope of the disclosure. Those skilled in the art will readily recognize various modifications and changes that may be made to the principles described herein without following the example embodiments and applications illustrated and described herein, and without departing from the spirit and scope of the disclosure.

While this specification contains many specific implementation details, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results.

As noted above, particular embodiments of the subject matter have been described, but other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In certain implementations, multitasking and parallel processing may be advantageous.

CONCLUSION

A system and method have been shown in the above embodiments for the effective implementation of an automated rod coil cutting station. While various preferred embodiments have been shown and described, it will be understood that there is no intent to limit the invention by such disclosure, but rather, it is intended to cover all modifications falling within the spirit and scope of the invention, as defined in the appended claims.

The invention claimed is:

1. A system comprising:

(a) a stem and a nose cone coaxially located above the stem;

(b) a reform tub coaxially located with the nose and stem, the reform tub enclosing the nose and at least a portion of the stem;

(c) at least one retractable iris mounted to the reform tub;

(d) a retractable shear mounted to the reform tub and located underneath the retractable iris;

(e) a coil plate located underneath the retractable shear; and (f) a robotic arm positioned underneath the retractable shear;

the controller: (1) setting the retractable iris to engage the nose while holding a coil within the reform tub, and upon the coil attaining a pre-determined height, the controller retracting, for a pre-determined time period, the retractable iris to no longer engage the nose wherein, upon such retraction for the pre-determined time period, a portion of the coil falls to the coil plate; (2) after expiration of the pre-determined time period, setting the retractable iris to engage the nose where a remainder of the coil is held within the reform tub; (3) setting the retractable shear to not impede with the portion of the coil or the remainder of the coil, wherein the portion of the coil and the remainder of the coil are separated by an umbilical cord, (4) setting the retractable shear to sever the umbilical cord, and (5) sending one or more instructions to the robotic arm to convey a severed end of the umbilical cord to a feed mechanism or a carrier.

2. The system of claim 1, wherein the system further comprising a height sensor to monitor the height of the coil, wherein the height sensor transmits a signal to the controller to indicate that the pre-determined height has been attained.

3. The system of claim 1, wherein the portion of the coil and the remainder of the coil are of equal height, wherein the equal height is ½ of coil's height.

4. The system of claim 1, wherein, prior to conveying the severed end of the umbilical cord to the feed mechanism or the carrier, a sample of coil is trimmed for analysis.

5. The system of claim 1, wherein the feed mechanism or the carrier is picked from a plurality of feed mechanisms or a plurality of carriers.

6. The system of claim 5, wherein feed mechanism or the carrier is picked based on any one of the following properties: wire diameter, steel grade, or finish temperature.

7. A method as implemented in a reform station unit of a wire rod mill system, the reform station unit comprising: a stem and a nose cone coaxially located above the stem; a reform tub coaxially located with the nose and stem, the reform tub enclosing the nose and at least a portion of the stem; at least one retractable iris mounted to the reform tub; a retractable shear mounted to the reform tub and located underneath the retractable iris; a coil plate located underneath the retractable shear; and a robotic arm positioned underneath the retractable shear, the method comprising the steps of:

(a) setting the retractable iris to engage the nose while holding a coil within the reform tub, and upon the coil attaining a pre-determined height, the controller retracting, for a pre-determined time period, the retractable iris to no longer engage the nose wherein, upon such retraction for the pre-determined time period, a portion of the coil falls to the coil plate;

(b) after expiration of the pre-determined time period, setting the retractable iris to engage the nose where a remainder of the coil is held within the reform tub;

(c) setting the retractable shear to not impede with the portion of the coil or the remainder of the coil, wherein the portion of the coil and the remainder of the coil are separated by an umbilical cord;

(d) setting the retractable shear to sever the umbilical cord, and (e) sending one or more instructions to the robotic arm to convey a severed end of the umbilical cord to a feed mechanism or a carrier.

8. A system comprising:

(a) a stem and a nose cone coaxially located above the stem;

(b) a reform tub coaxially located with the nose and stem, the reform tub enclosing the nose and at least a portion of the stem;

(c) at least one retractable iris mounted to the reform tub;

(d) a robotic arm with a shear mounted thereon and a set of pincers, the robotic arm and the pincers located beneath the retractable iris; and (e) a coil plate located underneath the robotic arm;

the controller: (1) setting the retractable iris to engage the nose while holding a coil within the reform tub, and upon the coil attaining a pre-determined height, the controller retracting, for a pre-determined time period, the retractable iris to no longer engage the nose wherein, upon such retraction for the pre-determined time period, a portion of the coil falls to the coil plate; (2) after expiration of the pre-determined time period, setting the retractable iris to engage the nose while holding a remainder of the coil within the reform tub; (3) setting the robotic arm and the set of pincers to not impede with the portion of the coil or the remainder of the coil, wherein the portion of the coil and the remainder of the coil are separated by an umbilical cord; (4) sending instructions to the set of pincers to position the umbilical cord for shearing; (5) sending instructions to the robotic arm to sever the umbilical cord using the shear mounted thereon, and (6) sending instructions to the robotic arm to convey a severed end of the umbilical cord to a feed mechanism or a carrier.

9. The system of claim 8, wherein the system further comprising a height sensor to monitor the height of the coil, wherein the height sensor transmits a signal to the controller to indicate that the pre-determined height has been attained.

10. The system of claim 8, wherein the portion of the coil and the remainder of the coil are of equal height, wherein the equal height is ½ of coil's height.

11. The system of claim 8, wherein, prior to conveying the severed end of the umbilical cord to the feed mechanism or the carrier, a sample of coil is trimmed for analysis.

12. The system of claim 8, wherein the feed mechanism or the carrier is picked from a plurality of feed mechanisms or a plurality of carriers.

13. The system of claim 12, wherein feed mechanism or the carrier is picked based on any one of the following properties: wire diameter, steel grade, or finish temperature.

14. A method as implemented in a reform station unit of a wire rod mill system, the reform station unit comprising: a stem and a nose cone coaxially located above the stem, a reform tub coaxially located with the nose and stem, the reform tub enclosing the nose and at least a portion of the stem, at least one retractable iris mounted to the reform tub, a robotic arm with a shear mounted thereon and a set of pincers, the robotic arm and the pincers located beneath the retractable iris, and a coil plate located underneath the robotic arm, the method comprising the steps of:

(a) setting the retractable iris to engage the nose while holding a coil within the reform tub, and upon the coil attaining a pre-determined height, the controller retracting, for a pre-determined time period, the retractable iris to no longer engage the nose wherein, upon such retraction for the pre-determined time period, a portion of the coil falls to the coil plate;

(b) after expiration of the pre-determined time period, setting the retractable iris to engage the nose while holding a remainder of the coil within the reform tub;

(c) setting the robotic arm and the set of pincers to not impede with the portion of the coil or the remainder of the coil, wherein the portion of the coil and the remainder of the coil are separated by an umbilical cord;

(d) sending instructions to the set of pincers to position the umbilical cord for shearing;

(e) sending instructions to the robotic arm to sever the umbilical cord using the shear mounted thereon; and (f) sending instructions to the robotic arm to convey a severed end of the umbilical cord to a feed mechanism or a carrier.

15. A system comprising:

(a) a stem and a nose cone coaxially located above the stem;

(b) a reform tub coaxially located with the nose and stem, the reform tub enclosing the nose and at least a portion of the stem;

(c) at least one retractable iris mounted to the reform tub;

(d) a first robotic arm with a shear mounted thereon, the robotic arm located beneath the retractable iris;

(e) a second robotic arm and a third robotic arm for positioning coils; and (f) a coil plate located underneath the first, second, and third robotic arms;

the controller: (1) setting the retractable iris to engage the nose while holding a coil within the reform tub, and upon the coil attaining a pre-determined height, the controller retracting, for a pre-determined time period, the retractable iris to no longer engage the nose wherein, upon such retraction for the pre-determined time period, a portion of the coil falls to the coil plate; (2) after expiration of the pre-determined time period, setting the retractable iris to engage the nose while holding a remainder of the coil within the reform tub; (3) setting the first, second and third robotic arms to not impede with the portion of the coil or the remainder of the coil, wherein the portion of the coil and the remainder of the coil are separated by an umbilical cord; (4) sending instructions to the second and third robotic arms to position the umbilical cord for shearing; (5) sending instructions to the first robotic arm to sever the umbilical cord using the shear mounted thereon, and (6) sending instructions to the first robotic arm to convey a severed end of the umbilical cord to a feed mechanism or a carrier.

16. The system of claim 15, wherein the severed end of the umbilical cord is conveyed to the feed mechanism or the carrier via a fourth robotic arm for conveying coils.

17. The system of claim 15, wherein the system further comprising a height sensor to monitor the height of the coil, wherein the height sensor transmits a signal to the controller to indicate that the pre-determined height has been attained.

18. The system of claim 15, wherein the portion of the coil and the remainder of the coil are of equal height, wherein the equal height is ½ of coil's height.

19. The system of claim 15, wherein, prior to conveying the severed end of the umbilical cord to the feed mechanism or the carrier, a sample of coil is trimmed for analysis.

20. The system of claim 15, wherein the feed mechanism or the carrier is picked from a plurality of feed mechanisms or a plurality of carriers.

21. The system of claim 20, wherein feed mechanism or the carrier is picked based on any one of the following properties: wire diameter, steel grade, or finish temperature.

22. A method as implemented in a reform station unit of a wire rod mill system, the reform station unit comprising: a stem and a nose cone coaxially located above the stem, a reform tub coaxially located with the nose and stem, the reform tub enclosing the nose and at least a portion of the stem, at least one retractable iris mounted to the reform tub, a first robotic arm with a shear mounted thereon, the robotic arm located beneath the retractable iris, a second robotic arm and a third robotic arm for positioning coils, and a coil plate located underneath the first, second, and third robotic arms, the method comprising the steps of:

(a) setting the retractable iris to engage the nose while holding a coil within the reform tub, and upon the coil attaining a pre-determined height, the controller retracting, for a pre-determined time period, the retractable iris to no longer engage the nose wherein, upon such retraction for the pre-determined time period, a portion of the coil falls to the coil plate;

(b) after expiration of the pre-determined time period, setting the retractable iris to engage the nose while holding a remainder of the coil within the reform tub;

(c) setting the first, second and third robotic arms to not impede with the portion of the coil or the remainder of the coil, wherein the portion of the coil and the remainder of the coil are separated by an umbilical cord;

(d) sending instructions to the second and third robotic arms to position the umbilical cord for shearing;

(e) sending instructions to the first robotic arm to sever the umbilical cord using the shear mounted thereon, and (f) sending instructions to the first robotic arm to convey a severed end of the umbilical cord to a feed mechanism or a carrier.

* * * * *